US005680930A

United States Patent [19]

Stone

[11] Patent Number: 5,680,930

[45] Date of Patent: Oct. 28, 1997

[54] TWO-PIECE, CRASH-BOTTOM BASKET CARRIER

[75] Inventor: James L. Stone, Grand Rapids, Mich.

[73] Assignee: Tenneco Packaging, Evanston, Ill.

[21] Appl. No.: 629,728

[22] Filed: Apr. 9, 1996

[51] Int. Cl.[6] ..... B65D 75/00

[52] U.S. Cl. ..... 206/173; 206/180; 206/198

[58] Field of Search ..... 206/170–176, 206/178, 180, 185, 198, 200

[56] References Cited

U.S. PATENT DOCUMENTS

| | | | |
|---|---|---|---|
| Re. 29,063 | 12/1976 | Graser . | |
| 2,362,990 | 11/1944 | Crane | 206/171 |
| 2,594,376 | 4/1952 | Arneson . | |
| 2,731,170 | 1/1956 | Bergstein . | |
| 2,765,100 | 10/1956 | DeMaria . | |
| 2,770,391 | 11/1956 | Metzger . | |
| 2,772,020 | 11/1956 | Kramer . | |
| 2,772,610 | 12/1956 | Arneson . | |
| 2,772,810 | 12/1956 | Arneson . | |
| 2,774,512 | 12/1956 | Dunning . | |
| 2,776,072 | 1/1957 | Forrer . | |
| 2,778,526 | 1/1957 | Forrer . | |
| 2,781,150 | 2/1957 | Bergstein . | |
| 2,783,916 | 3/1957 | Hodapp . | |
| 2,785,827 | 3/1957 | Forrer . | |
| 2,794,572 | 6/1957 | Goss . | |
| 2,795,352 | 6/1957 | Ringler . | |
| 2,797,845 | 7/1957 | Guyer et al. . | |
| 2,820,570 | 1/1958 | Ringler . | |
| 2,820,571 | 1/1958 | Ringler . | |
| 2,820,572 | 1/1958 | Ringler . | |
| 2,835,408 | 5/1958 | Arneson . | |
| 2,842,288 | 7/1958 | Dunning et al. . | |
| 2,844,280 | 7/1958 | Ringler . | |
| 2,844,281 | 7/1958 | Ringler . | |
| 2,844,282 | 7/1958 | Painter . | |
| 2,846,114 | 8/1958 | Ringler . | |
| 2,848,136 | 8/1958 | Ringler . | |
| 2,860,816 | 11/1958 | Fielding . | |
| 2,877,736 | 3/1959 | Simmons . | |
| 2,887,245 | 5/1959 | Levkoff . | |
| 2,887,246 | 5/1959 | Levkoff . | |
| 2,905,359 | 9/1959 | Arneson . | |
| 2,919,829 | 1/1960 | Forrer . | |
| 2,932,424 | 4/1960 | Arneson . | |
| 2,932,425 | 4/1960 | Freeman . | |
| 2,957,602 | 10/1960 | Ryder . | |
| 2,965,261 | 12/1960 | Holmes . | |
| 2,974,827 | 3/1961 | Levkoff . | |

(List continued on next page.)

FOREIGN PATENT DOCUMENTS

| | | | |
|---|---|---|---|
| 538858 | 4/1957 | Canada | 206/174 |

*Primary Examiner*—Paul T. Sewell
*Assistant Examiner*—Nhan T. Lam
*Attorney, Agent, or Firm*—Arnold, White & Durkee

[57] ABSTRACT

A two-piece, crash-bottom basket carrier includes a bottom wall, a pair of opposing side walls, a pair of opposing end walls, a longitudinal partition, and one or more transverse partitions. The side walls and the end walls extend upward from the bottom wall, and the end walls bridge the opposing side walls. The bottom wall, the side walls, and the end walls are all formed from a first unitary paperboard blank. The longitudinal partition extends between the opposing end walls and is located approximately midway between the opposing side walls. The longitudinal partition is generally perpendicular to the bottom wall and the end walls and is generally parallel to the side walls. A handle is formed along an upper central handle section of the longitudinal partition to permit carrying of the basket carrier. Each of the transverse partitions extends between the longitudinal partition and one of the side walls. The transverse partitions are generally perpendicular to the bottom wall and the side walls and are generally parallel to the end walls. The transverse partitions serve to divide the interior of the basket carrier into multiple cells suitable for receiving respective beverage bottles. The longitudinal and transverse partitions are formed from a second unitary paperboard blank.

21 Claims, 14 Drawing Sheets

U.S. PATENT DOCUMENTS

| | | | |
|---|---|---|---|
| 2,977,021 | 3/1961 | Shiels, Jr. . | |
| 2,998,900 | 9/1961 | Struble . | |
| 3,011,677 | 12/1961 | Struble . | |
| 3,121,523 | 2/1964 | Hasselo . | |
| 3,258,190 | 6/1966 | Wood . | |
| 3,389,831 | 6/1968 | Hirota | 206/172 |
| 3,411,663 | 11/1968 | Moore et al. . | |
| 3,929,274 | 12/1975 | Akkerman | 206/139 |
| 3,986,658 | 10/1976 | Arneson et al. . | |
| 4,007,830 | 2/1977 | Calvert . | |
| 4,172,546 | 10/1979 | Oliff et al. . | |
| 4,204,596 | 5/1980 | Davis . | |
| 4,319,682 | 3/1982 | Wright et al. | 206/180 |
| 4,403,690 | 9/1983 | Fischer | 206/180 |
| 4,509,640 | 4/1985 | Joyce . | |
| 4,549,650 | 10/1985 | Champlin . | |
| 4,588,077 | 5/1986 | Champlin et al. . | |
| 4,601,390 | 7/1986 | Rosenthal et al. . | |
| 4,610,349 | 9/1986 | Schwartz et al. . | |
| 4,611,712 | 9/1986 | Stone . | |
| 4,703,847 | 11/1987 | Oliff . | |
| 4,722,437 | 2/1988 | Walsh . | |
| 4,770,294 | 9/1988 | Graser . | |
| 4,782,943 | 11/1988 | Blackman . | |
| 4,782,944 | 11/1988 | Engdahl, Jr. . | |
| 4,792,038 | 12/1988 | Cooper . | |
| 4,798,285 | 1/1989 | Hernandez . | |
| 4,798,291 | 1/1989 | Carver . | |
| 4,838,414 | 6/1989 | Blackman . | |
| 4,852,731 | 8/1989 | Cooper . | |
| 4,890,738 | 1/1990 | Carver . | |
| 4,913,291 | 4/1990 | Schuster . | |
| 4,913,339 | 4/1990 | Elder . | |
| 4,915,218 | 4/1990 | Crouch et al. . | |
| 4,919,261 | 4/1990 | Lashyro et al. . | |
| 4,927,009 | 5/1990 | Stout . | |
| 4,929,223 | 5/1990 | Walsh . | |
| 4,930,629 | 6/1990 | Petty . | |
| 4,989,779 | 2/1991 | Lashyro | 206/173 |
| 5,029,698 | 7/1991 | Stout . | |
| 5,221,001 | 6/1993 | Eisman . | |
| 5,234,103 | 8/1993 | Schuster . | |
| 5,303,863 | 4/1994 | Arasim . | |
| 5,328,024 | 7/1994 | Sutherland . | |
| 5,332,091 | 7/1994 | Gugler . | |
| 5,333,734 | 8/1994 | Stout et al. . | |
| 5,579,904 | 12/1996 | Holley, Jr. | 206/180 |

TWO-PIECE, CRASH-BOTTOM BASKET CARRIER

FIELD OF THE INVENTION

The present invention relates generally to paperboard basket-style bottle carriers for holding multiple beverage bottles and, more particularly, relates to a two-piece, crash-bottom basket carrier which realizes paperboard savings, improves utilization and throughput of printing press and die-cutting equipment, and allows for the use of less expensive materials for making certain portions of the carrier.

BACKGROUND OF THE INVENTION

A typical basket carrier for holding multiple beverage bottles includes a bottom wall, a pair of opposing side walls, a pair of opposing end walls, a longitudinal partition, and one or more transverse partitions. The side walls and the end walls extend upward from the bottom wall, and the end walls bridge the opposing side walls. The longitudinal partition extends between the opposing end walls and is located approximately midway between the opposing side walls. The longitudinal partition is generally perpendicular to the bottom wall and the end walls and is generally parallel to the side walls. A handle is formed along an upper central section of the longitudinal partition to permit carrying of the basket carrier. Each of the transverse partitions extends between the longitudinal partition and one of the side walls. The transverse partitions are generally perpendicular to the bottom wall and the side walls and are generally parallel to the end walls. Furthermore, the transverse partitions serve to divide the interior of the basket carrier into multiple cells suitable for receiving respective beverage bottles. Typically, the number of transverse partitions is chosen to be two or four so as to divide the interior of the basket carrier into four and six cells, respectively.

Historically, basket carriers of the foregoing type have been made from a single blank of paperboard which is die-cut, creased, folded, glued, and finally erected by hand or machine to produce a basket carrier. The use of a single blank to form a basket carrier is undesirable for several reasons. First, the use of a single blank does not optimally utilize rotogravure printing press and die-cutting equipment. Typically, multiple blanks (e.g., four blanks) are printed upon during a single rotation era printing cylinder on the rotogravure printing press, and these multiple blanks are then simultaneously die-cut and scored during a single oscillation of the die-cutting equipment. When the blanks passing through the printing press include portions which do not require printing (e.g., the panels which form the internal partitions of the basket carrier), these non-printed portions occupy valuable space which is not utilized by the printing press. The non-printed potions cause the printing press to be underutilized by wasting valuable press time. It would be preferable to design a basket carrier from a blank construction which allows only portions requiting printing to be passed through the rotogravure printing press while the non-printed portions are processed separately. By sending only portions requiting printing through the printing press and then the die-cutting equipment, more blanks can be processed during each rotation of the printing cylinder and each oscillation of the die-cutting equipment, thereby increasing the throughput of these machines.

Even if printing is desired on the panels forming the internal partitions of the basket carrier, such printing is typically promotional in nature such that it changes relatively frequently over time. The use of a rotogravure printing press is undesirable for such less permanent types of printing because the cost of the printing plates of the rotogravure printing press is quite expensive and because modifying the printing plate is a time-consuming and labor intensive task. It would be preferable to be able to send these portions of the basket carrier through a different printing press, such as an offset-type printing press, which facilitates frequent changes in printing and is more cost-effective.

Second, the single blank used to form the basket carrier typically has an irregular shape which makes it difficult to form a large number of blanks in closely-spaced relationship. As stated above, multiple blanks are printed upon during each rotation of the printing cylinder, and these printed blanks are then simultaneously die-cut and scored during a single oscillation of the die-cutting equipment. The closer the blanks are spaced relative to each other, the greater the number of blanks which can be processed during each printing cylinder rotation and each oscillation of the die-cutting equipment. The irregularities accompanying the single blanks used to form respective basket carriers create gaps between the simultaneously processed blanks, thereby failing to optimally use the paperboard material from which the blanks are produced and failing to allow reasonable nesting to promote equipment efficiencies.

Third, the use of a single blank to form a basket carrier necessarily means that the basket carrier is formed from one material. In order for the basket carrier to have sufficient structural integrity to withstand tearing while the carrier is handled with bottles disposed therein, the basket carrier is generally formed from a strong virgin paperboard material such as clay-coated solid unbleached sulfate (SUS). Such virgin paperboard material is more expensive than recycled paperboard materials and is unnecessary for providing the requisite mount of tear resistance in certain areas of the basket carrier. In particular, the side walls, end walls, and bottom wall of the basket carrier do not require as high a strength material as is required by the handle region of the longitudinal partition because stresses during handling of the basket carrier are focused on this handle region. Therefore, it would be desirable to be able to form the less stressed portions of the basket carrier out of a less expensive material such as recycled paperboard (e.g., clay-coated news), while only forming the more stressed handle region out of the more expensive and stronger virgin paperboard. Heretofore, this has not been possible because existing basket carriers are formed from a single paperboard blank.

A need therefore exists for a basket carrier which overcomes the aforementioned shortcomings associated with existing basket carriers.

SUMMARY OF THE INVENTION

In one particular embodiment, a basket carrier includes a bottom wall, a pair of opposing side walls, a pair of opposing end walls, a longitudinal partition, and one or more transverse partitions. The side walls and the end walls extend upward from the bottom wall, and the end walls bridge the opposing side walls. The bottom wall, the side walls, and the end walls are all formed from a first paperboard blank. The longitudinal partition extends between the opposing end walls and is located approximately midway between the opposing side walls. The longitudinal partition is generally perpendicular to the bottom wall and the end walls and is generally parallel to the side walls. A handle is formed along an upper central handle section of the longitudinal partition to permit carrying of the basket carrier. Each of the transverse partitions extends between the longitudinal partition and one of the side walls. The transverse partitions are generally perpendicular to the bottom wall and the side walls and are generally parallel to the end walls. The transverse partitions serve to divide the interior of the basket carrier into multiple cells suitable for receiving respective beverage bottles. The longitudinal and transverse partitions are formed from a second paperboard blank preferably composed of a virgin paperboard material such as clay-coated solid unbleached sulfate. The first paperboard blank is preferably composed of a recycled paperboard material such as clay-coated news. The two-piece basket carrier is of a crash-bottom type, which means that the basket carrier is first produced in flattened (non-erected) form and is then convertible from the flattened form to an erected form in response to applying pressure to the bottom wall of the basket carrier.

The height of the side walls and end walls relative to the longitudinal partition can be modified to increase or decrease the amount of the handle section which is exposed. Also, the handle can be formed from two, three, four, or more overlapping plies (layers) of paperboard, depending upon the amount of strength desired in the handle section.

The present invention further provides a blank structure, including first and second paperboard blanks, used to form the basket carrier described above. The present invention also provides a method of manufacturing the basket carrier.

The above summary of the invention is not intended to represent each embodiment, or every aspect, of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
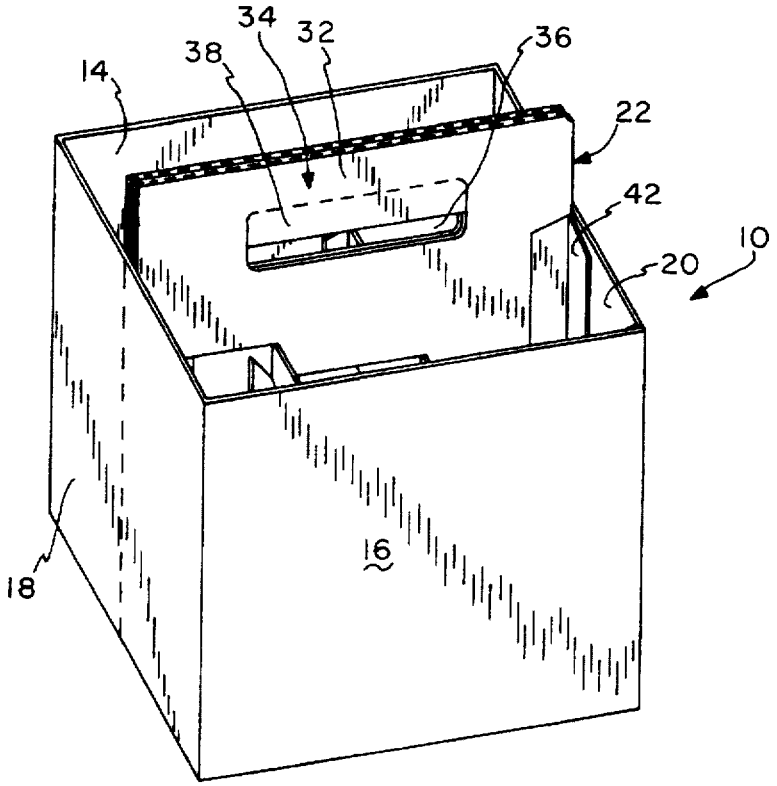
FIG. 1 is an isometric view of a basket carrier embodying the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DETAILED DESCRIPTION OF THE INVENTION

Figure 2:
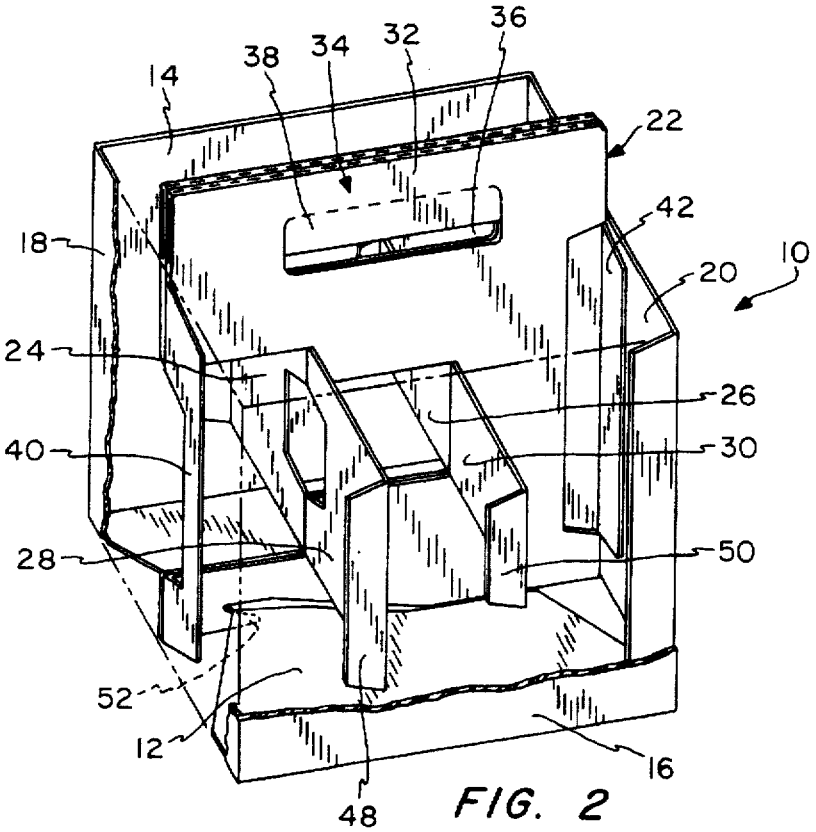
FIG. 2 is another isometric view of the basket carrier embodying the present invention, with portions broken away to reveal internal structure.
Figure 3:
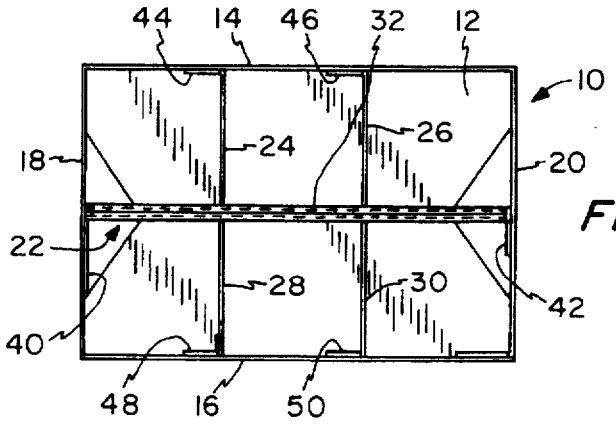
FIG. 3 is a top view of the basket carrier embodying the present invention.

Turning now to the drawings, FIGS. 1–3 depict a two-piece, crash-bottom basket carrier 10 embodying the present invention. The basket carrier 10 includes a bottom wall 12, a pair of opposing side walls 14 and 16, a pair of opposing end walls 18 and 20, a longitudinal partition 22, and a plurality of transverse partitions 24, 26, 28, and 30. The side walls 14 and 16 and the end walls 18 and 20 are perpendicular to and extend upward from the bottom wall 12. The end walls 18 and 20 are generally perpendicular to and bridge the opposing side walls 14 and 16 so as to provide the basket carrier 10 with a generally rectangular interior compartment. The longitudinal partition 22 extends between the opposing end walls 18 and 20 and is located approximately midway between the opposing side walls 14 and 16. The longitudinal partition 22 is generally perpendicular to the bottom wall 12 and the end walls 18 and 20 and is generally parallel to the side walls 14 and 16. A handle 32 is formed along an upper central handle section 34 of the longitudinal partition 22 to permit carrying of the basket carrier 10.

As best shown in FIG. 3, each of the transverse partitions 24, 26, 28, and 30 extends between the longitudinal partition 22 and an associated one of the side walls 14 and 16. Specifically, the transverse partitions 24 and 26 extend between the longitudinal partition 22 and the side wall 14, and the transverse partitions 28 and 30 extend between the longitudinal partition 22 and the side wall 16. The transverse partitions 24, 26, 28, and 30 are generally perpendicular to the bottom wall 12 and the side walls 14 and 16 and are generally parallel to the end walls 18 and 20. The illustrated transverse partitions 24, 26, 28, and 30 serve to divide the interior compartment of the basket carrier 10 into six cells suitable for receiving respective beverage bottles. The number of transverse partitions can, of course, be modified to increase or decrease the number of interior cells. Two transverse partitions, for example, would create a basket carrier with four interior cells, which is the number of cells widely used for basket carriers holding wine coolers. The transverse partitions 24, 26, 28, and 30 are spaced relative to each other and relative to the end walls 18 and 20 so that the cells are generally square in configuration. In a preferred embodiment, the cells are sized to receive twelve-ounce beverage bottles.

The upper central handle section 34 defines a longitudinal slot 36 to form the handle 32. When a consumer carries the basket carrier 10 by the handle 32, the consumer wraps their hand about the handle 32 in conventional fashion such that their palm contacts an upper edge of the handle 32, their thumb extends about one side of the handle 32, and their fingers extend about the other side of the handle 32 and through the slot 36. The handle 32 preferably includes overlapping hinged lower flaps 38 which rotate away from the vertical direction in response to the consumer inserting their fingers through the slot 36. The hinged lower flaps 38 allow the slot 36 to better accommodate the fingers of the consumer and minimizes any discomfort which the consumer might experience while carrying the basket carrier 10 due to any stresses the handle 32 might place on the fingers of the consumer.

As best shown in FIG. 3, a plurality of glue flaps and tabs are used to adhere the longitudinal partition 22 and the transverse partitions 24, 26, 28, and 30 to the end walls 18 and 20 and side walls 14 and 16 of the basket carrier 10. In particular, opposing ends of the longitudinal partition 22 are adhered to the respective end walls 18 and 20 by respective glue flaps 40 and 42. The transverse partitions 24 and 26 are adhered at one end to the side wall 14 by respective glue tabs 44 and 46, and are hingedly connected to the longitudinal partition 22 at the other end. Similarly, the transverse partitions 28 and 30 are adhered at one end to the side wall 16 by respective glue tabs 48 and 50, and are hingedly connected to the longitudinal partition 22 at the other end.

In addition to being attached to the end walls 18 and 20, the longitudinal partition 22 is releasably engaged to the bottom wall 12 by a conventional locking tab 52 (FIG. 2). The locking tab 52 is formed along the lower edge of the longitudinal partition 22 and supports an edge of the bottom wall 12 to maintain the basket carrier 10 in erected form. The basket carrier 10 may be collapsed into non-erected form (see FIG. 10) by disengaging the bottom wall 12 from the locking tab 52.

Figure 4:
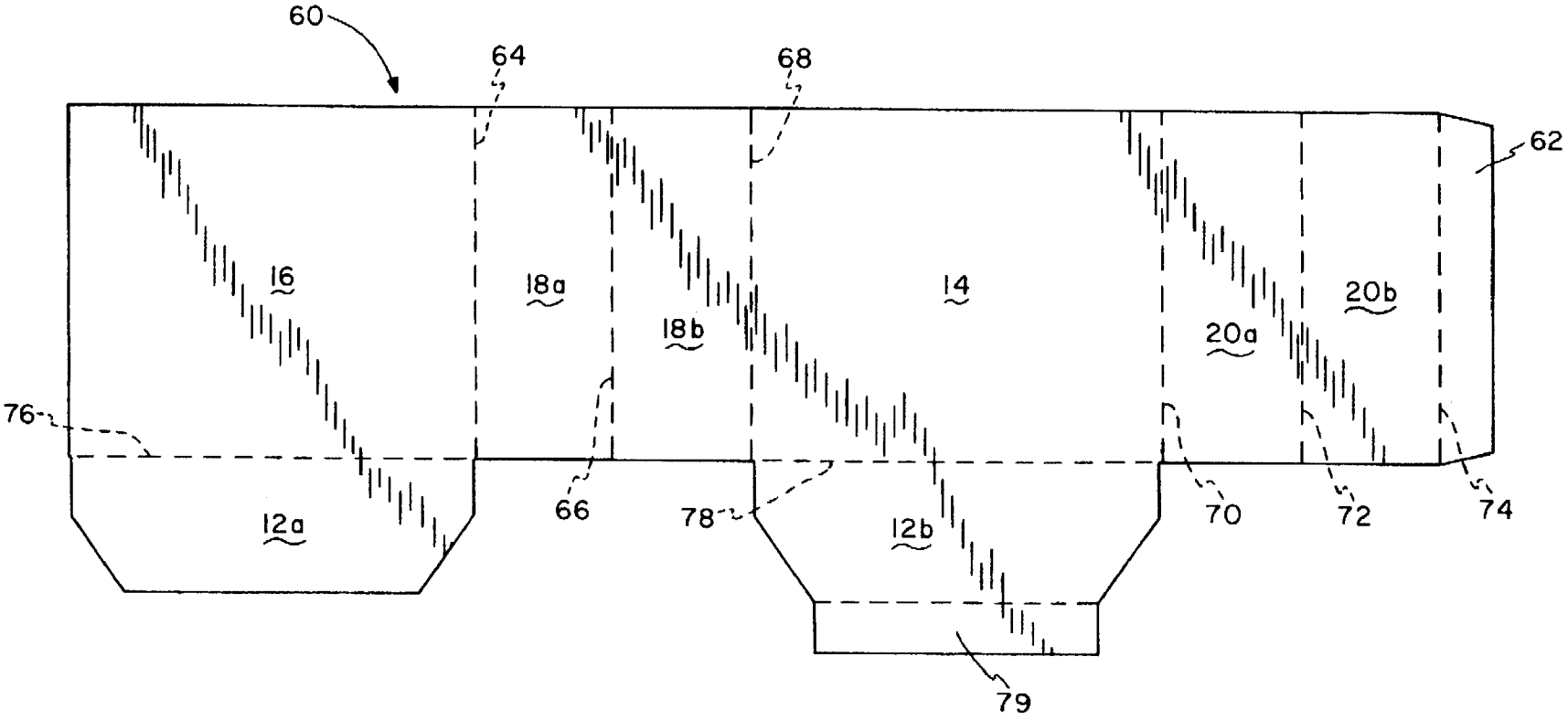
FIG. 4 is a top plan view of an inside surface of a first paperboard blank used to form a bottom wall, side walls, and end walls of the basket carrier in FIGS. 1–3.
Figure 5:
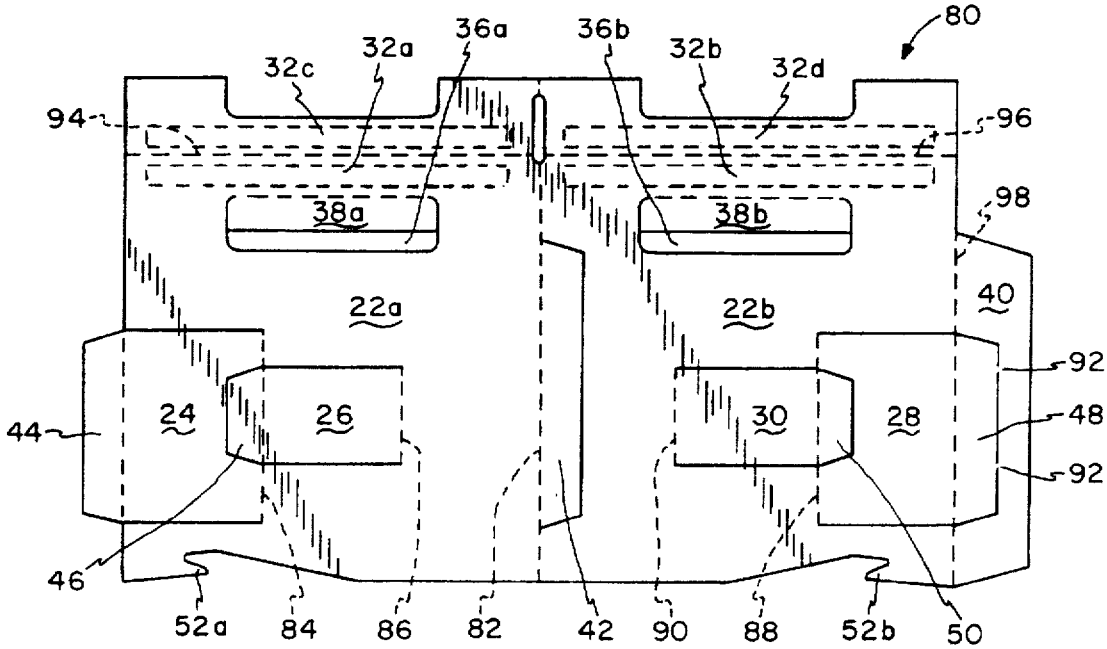
FIG. 5 is a top plan view of an inside surface of a second paperboard blank used to form a longitudinal partition (including handle section) and transverse partitions of the basket carrier in FIGS. 1–3.

The basket carrier 10 is formed from first and second paperboard blanks depicted in FIGS. 4 and 5, respectively. The first paperboard blank 60, illustrated in FIG. 4, is used to form the bottom wall 12, side walls 14 and 16, and end walls 18 and 20 of the basket carrier 10 in FIGS. 1–3. The second paperboard blank 80, illustrated in FIG. 5, is used to form the longitudinal partition 22 (including handle section) and transverse partitions 24, 26, 28, and 30 of the basket carrier 10 in FIGS. 1–3. Each of these blanks 60 and 80 and the procedure for interconnecting, folding, and gluing these blanks to form the basket carrier 10 are described below with reference to FIGS. 4–10. With respect to the basket carrier 10 in FIGS. 1–3, corresponding parts of the blanks 60 and 80 are identified by the same reference numerals.

Referring first to FIG. 4, there is shown an inner surface of the first paperboard blank 60, which is preferably composed of a recycled paperboard material such as clay-coated news. The use of recycled paperboard material is desirable because it is inexpensive compared to virgin paperboard material and it is sufficiently strong and tear resistant to withstand the lighter stresses applied to the bottom wall 12, side walls 14 and 16, and end walls 18 and 20 during handling of the basket carrier 10. The first paperboard blank 60 includes a plurality of panels and flaps hingedly connected about vertical and horizontal fold lines.

More specifically, the first blank 60 includes the side wall panels 14 and 16, the end wall panels **18*a–b* and 20*a–b*, and a glue flap 62 hingedly connected about a series of vertical fold lines 64, 66, 68, 70, 72, and 74. The end wall panels 18*a–b* form the end wall 18 and the end wall panels 20*a–b* form the end wall 20 of the erected basket carrier 10 in FIGS. 1–3. The side wall panel 16 is hingedly connected to the end wall panel 18*a* about the vertical fold line 64; the end wall panel 18*a* is hingedly connected to the end wall panel 18*b* about the vertical fold line 66; the end wall panel 18*b* is hingedly connected to the side wall panel 14 about the vertical fold line 68; the side wall panel 14 is hingedly connected to the end wall panel 20*a* about the vertical fold line 70; the end wall panel 20*a* is hingedly connected to the end wall panel 20*b* about the vertical fold line 72; and, finally, the end wall panel 20*b* is hingedly connected to the glue flap 62 about the vertical fold line 74**.

The first blank 60 further includes the bottom wall panels **12*a–b* hingedly connected to the respective side wall panels 16 and 14 about respective horizontal fold lines 76 and 78. The bottom wall panels 12*a–b* form the bottom wall 12 of the erected basket carrier 10 in FIGS. 1–3. A glue tab 79 is hingedly connected to the bottom wall panel 12*b*** about a horizontal fold line.

The periphery of the blank 60 is configured to have a regular shape and such that multiple ones of such blanks 60 can be nested with (i.e., formed closely adjacent to) one another during printing press and die-cutting operations. Such nesting of blanks is advantageous because it allows a rotogravure printing press to maximize the number of blanks printed during a single rotation of the printing cylinder of the printing press and it allows the downstream die-cutting equipment to maximize the number of blanks which are die-cut and scored during a single oscillation of the die-cutting equipment. In a preferred embodiment, six blanks can be processed during a single cycle of the printing press and die-cutting equipment, where a single cycle may be defined as a single printing cylinder rotation and a single die-cutting oscillation. Maximizing the number of blanks processed in each cycle, in turn, maximizes the throughput of the printing press and die-cutting equipment.

To nest the blank 60 with an identical blank, the identical blank can be positioned immediately above the blank 60 but inverted upside down relative to the blank 60. In this position, the identical blank has a straight lower horizontal edge which abuts the straight upper horizontal edge of the illustrated blank 60. The identically blank can alternatively be positioned immediately below the blank 60 but once again inverted upside down relative to the blank 60. In this case, the bottom wall panel **12*b* of the identically blank is nested between the bottom wall panels 12*a–b* of the blank 60 and is located immediately below the end wall panels 18*a–b* of the blank 60. Likewise, the bottom wall panel 12*b* of the blank 60 is nested between the bottom wall panels 12*a–b* of the identical blank and is located immediately above the end wall panels 18*a–b* of the identical blank. The regular shape of the blank 60** facilitates nesting in the manner described above.

Referring to FIG. 5, there is shown an inner surface of the second paperboard blank 80, which is preferably composed of a virgin paperboard material such as clay-coated solid unbleached sulfate. The use of virgin paperboard material is desirable because the second blank 80, as previously stated, forms the longitudinal partition 22 and transverse partitions 24, 26, 28, and 30 of the basket carrier 10 and higher stresses are applied to these portions, especially the handle section 34 of the longitudinal partition 22. The virgin paperboard material is sufficiently strong and tear resistant to withstand these higher stresses. Since the basket carrier 10 is formed out of two blanks, i.e., the first and second blanks 60 and 80, only the second blank 80 needs to be composed of the more expensive, but stronger, virgin paperboard material while the first blank 60 can still be composed of the less expensive and weaker recycled paperboard material. In a basket carrier with four cells, both the first and second blanks 60 and 80 may optionally be composed of recycled paperboard material. In a basket carrier with eight or ten cells, both the first and second blanks 60 and 80 may optionally be composed of virgin paperboard material.

The second paperboard blank 80 includes a plurality of panels and flaps hingedly connected about vertical and horizontal fold lines. More specifically, the second blank 80 includes the longitudinal partition panels 22*a–b* hingedly connected to each other about a vertical fold line 82. The longitudinal partition panels 22*a–b* form the longitudinal partition 22 of the erected basket carrier 10 in FIGS. 1–3. Die-cut into the second blank 80 are the plurality of transverse partition panels 24, 26, 28, and 30. The transverse partition panels 24 and 26 are partially encompassed by the longitudinal partition panel 22*a* and are hingedly connected thereto by respective vertical fold lines 84 and 86. The transverse partition panels 28 and 30 are partially encompassed by the longitudinal partition panel 22*b* and are hingedly connected thereto by respective vertical fold lines 88 and 90. Prior to erecting the basket carrier 10, the glue tab 48 extending from the transverse partition panel 28 is detachably connected to the glue flap 40 extending from the longitudinal partition panel 22*b* by a pair of weakening nicks 92. As will be described below, the weakening nicks 92 are ruptured in response to erecting the basket carrier 10 from the non-erected form illustrated in FIG. 10.

The lower edges of the respective longitudinal partition panels 22*a* and 22*b* form the locking tab portions 52*a* and 52*b* which, in turn, form the locking tab 52 of the erected basket carrier 10 in FIGS. 1–3. Handle portions 32*a–d* form the handle 32 of the erected basket carrier 10 in FIGS. 1–3. The handle portions 32*a* and 32*b* are formed along upper central sections of the respective longitudinal partitions 22*a* and 22*b*. The handle portions 32*c* and 32*d* are hingedly connected to the respective handle portions 32*a* and 32*b* about respective horizontal fold lines 94 and 96. The handle portions 32*a* and 32*b* form outer plies of the handle 32 of the erected basket carrier 10, while the handle portions 32*c* and 32*d* form inner plies of the handle 32. The use of four plies to form the handle 32 is especially advantageous in situations requiring substantial strength and tear resistance in the handle region. To further increase the strength of the handle region, a reinforcing tape or filament is optionally applied to one or more of the inner surfaces of the handle portions 32*a*, 32*b*, 32*c*, and 32*d*.

Hinged lower flap portions 38*a* and 38*b* and elongated slots 36*a* and 36*b* are also formed along the upper central handle sections of the respective longitudinal partitions 22*a* and 22*b*. The hinged flap portions 38*a* and 38*b* form the overlapping hinged flaps 38 and the elongated slots 36*a* and 36*b* form the longitudinal slot 36 of the erected basket carrier 10 in FIGS. 1–3.

Like the first blank 60, the second blank 80 has a regular shape, e.g., a generally rectangular shape, which allows the second blank 80 to be closely nested with identical second blanks during die-cutting operations and, if printing is desired, during printing operations as well. Such close nesting of the second blank 80 with identical second blanks, in turn, increases the throughput of the printing press (if used) and die-cutting equipment by maximizing the number of blanks processed during each cycle of such machinery. As previously stated, the use of the second blank 80 distinct from the first blank 60 permits the first and second blanks 60 and 80 to be composed of different paperboard materials. Likewise, the use of the second blank 80 distinct from the first blank 60 optimizes the efficiency of printing operations. Often, the first blank 60 requires printing which changes relatively little over time, and the second blank 80 either requires no printing or printing which changes relatively often over time. Therefore, the first blank 60 can be passed through a high-speed rotogravure printing press appropriate for more permanent printing applications, while the second blank 80 is processed separately. By being distinct from the first blank 60, the second blank 80 does not slow down the printing operations attendant the first blank 60. In situations where printing on the second blank 80 is desired, the second blank 80 can still be passed through an offset printing press appropriate for less permanent printing applications. Thus, the first and second blank 60 and 80 can be separately processed in an efficient and cost-effective manner.

Figure 7:
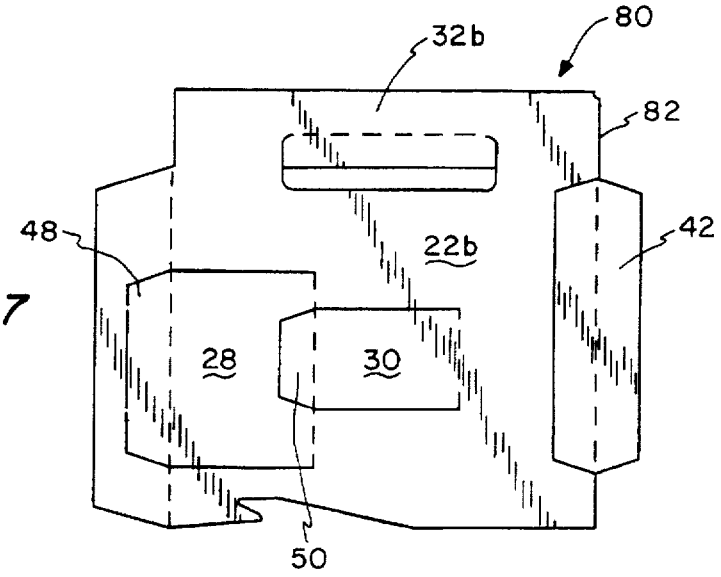
FIGS. 6 and 7 are top plan views showing the sequence of folding and gluing the second paperboard blank in FIG. 5 prior to joining the second paperboard blank with the first paperboard blank in FIG. 4.
Figure 6:
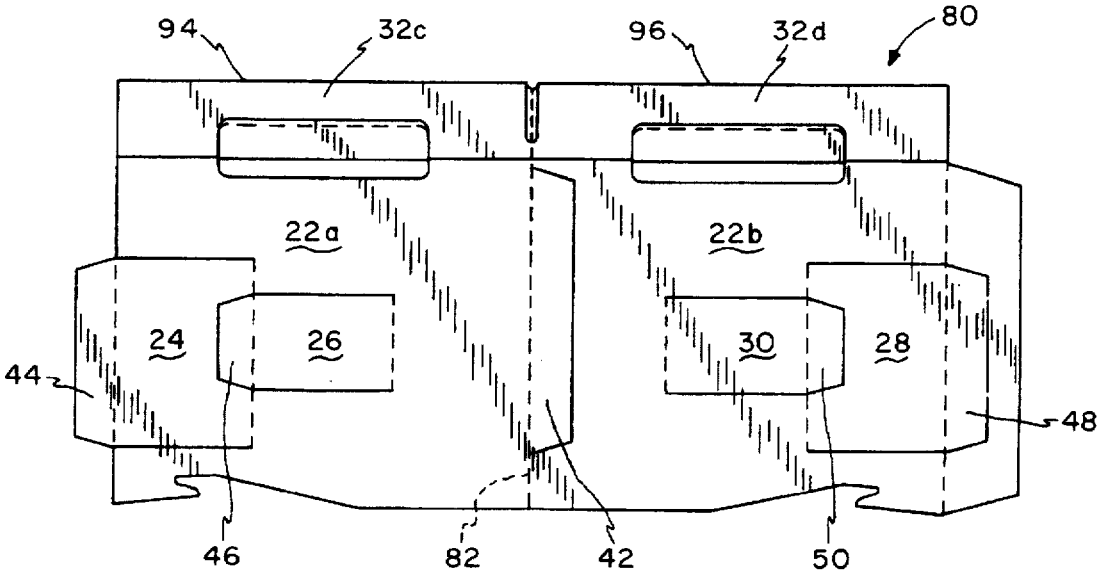

FIGS. 6 and 7 depict the sequence of folding and gluing the second paperboard blank 80 prior to joining the second paperboard blank 80 to the first paperboard blank 60. To achieve the blank configuration in FIG. 6 from the blank configuration in FIG. 5, the handle portions 32*c* and 32*d* are folded downward approximately 180 degrees relative to the respective handle portions 32*a* and 32*b* about the respective horizontal fold lines 94 and 96. The inner surfaces of the handle portions 32*c* and 32*d* are adhered to the inner surfaces of the respective handle portions 32*a* and 32*b*. To achieve the blank configuration in FIG. 7 from the blank configuration in FIG. 6, the longitudinal partition panel 22*b* is folded approximately 180 degrees relative to the longitudinal partition panel 22*a* about the vertical fold line 82. The inner surface of the longitudinal partition panel 22*b* is adhered to the inner surface of the longitudinal partition panel 22*a*, and the outer surface of the handle portion 32*d* is adhered to the outer surface of the handle portion 32*c*. The inner surfaces of the transverse partition panels 24, 26, 28, and 30, the glue tabs 44, 46, 48, and 50, and the glue flap 42 remain free of adhesive.

Figure 8:
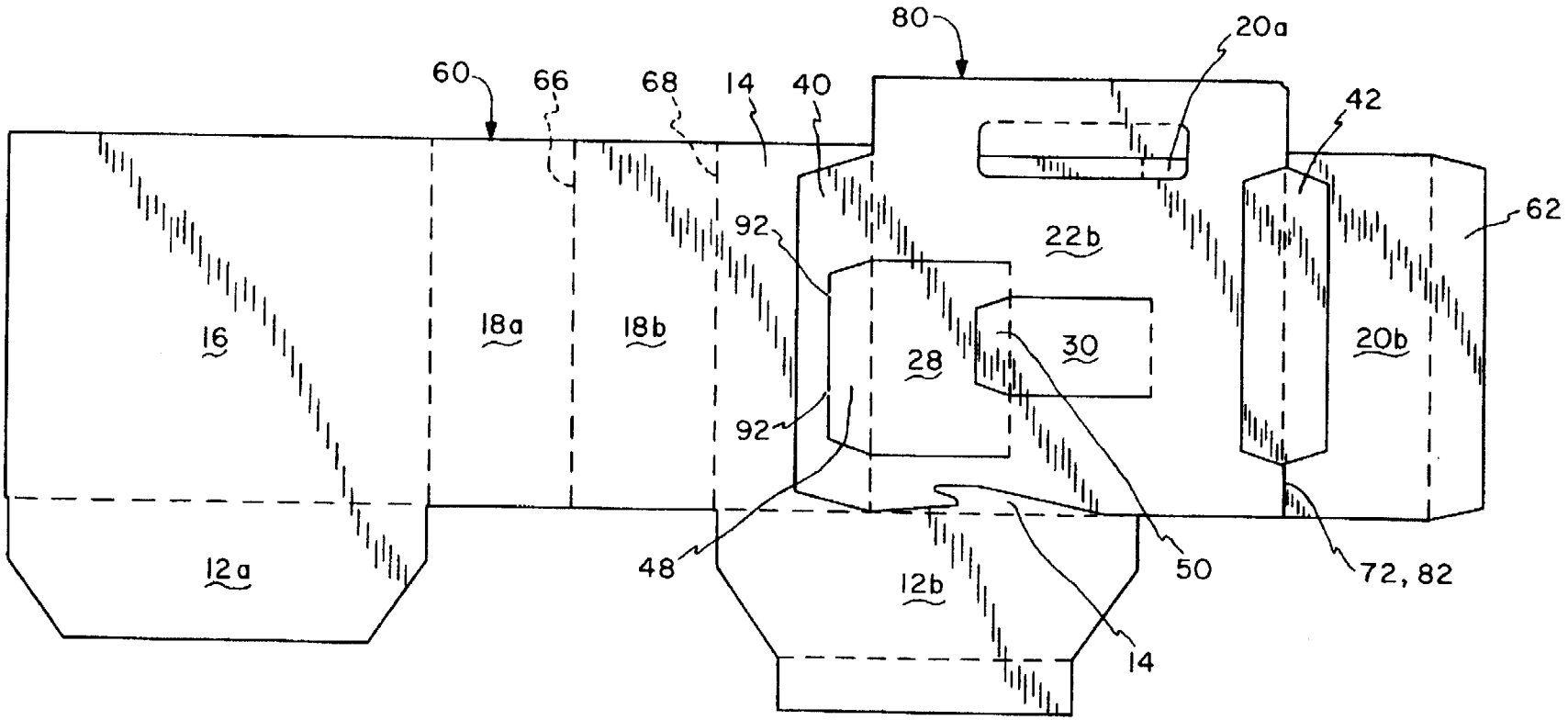
FIG. 8 is a top plan view of the first and second paperboard blanks showing the initial positioning of these blanks relative to each other.

After the second paperboard blank 80 is folded and glued into the form illustrated in FIG. 7, the second paperboard blank 80 is positioned on and adhered to the first paperboard blank 60 as depicted in FIG. 8. More specifically, the fold line 82 of the second paperboard blank 80 is aligned with the fold line 72 of the first paperboard blank 60, and the lowermost edge of the second paperboard blank 80 is aligned with the lower edges of the side wall panel 14 and end wall panel 20*a* of the first paperboard blank 60. To facilitate alignment of the fold line 82 of the second blank 80 with the fold line 72 of the first blank 60, the end wall panel 20*b* may be folded approximately 90 degrees relative to the end wall panel 20*a* about the fold line 72 prior to placing the second blank 80 on the first blank 60 (not shown). The upwardly projecting end wall panel 20*b* gauges the relative positions of the fold line 82 of the second blank 80 and the fold line 72 of the first blank 60. Preferably using a hot melt adhesive, the outer surfaces of the glue tabs 44 and 46 are adhered to the inner surfaces of the side wall panel 14. Also, the outer surface of the glue flap 42 is adhered to the inner surface of the end wall panel 20*b*.

Figure 10:
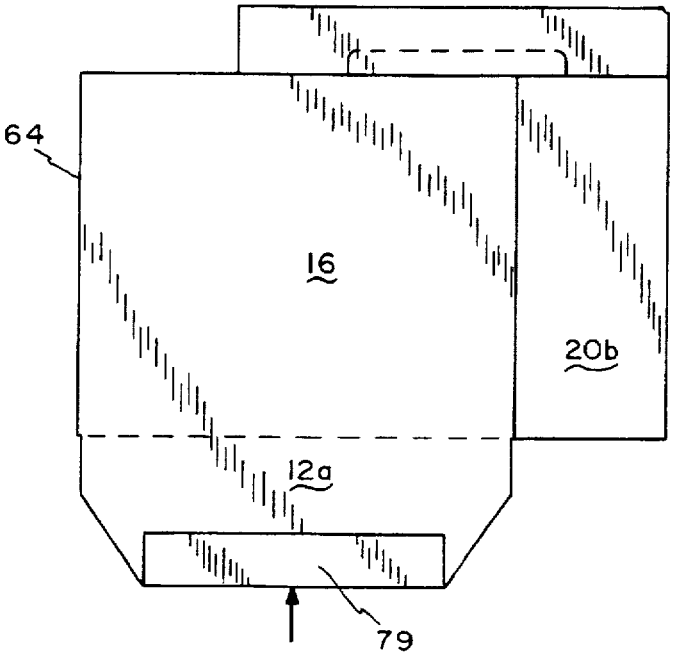
FIGS. 9 and 10 are top plan view showing the sequence of folding and gluing the first and second paperboard blanks to form the basket carrier in non-erected (flattened) form.
Figure 9:
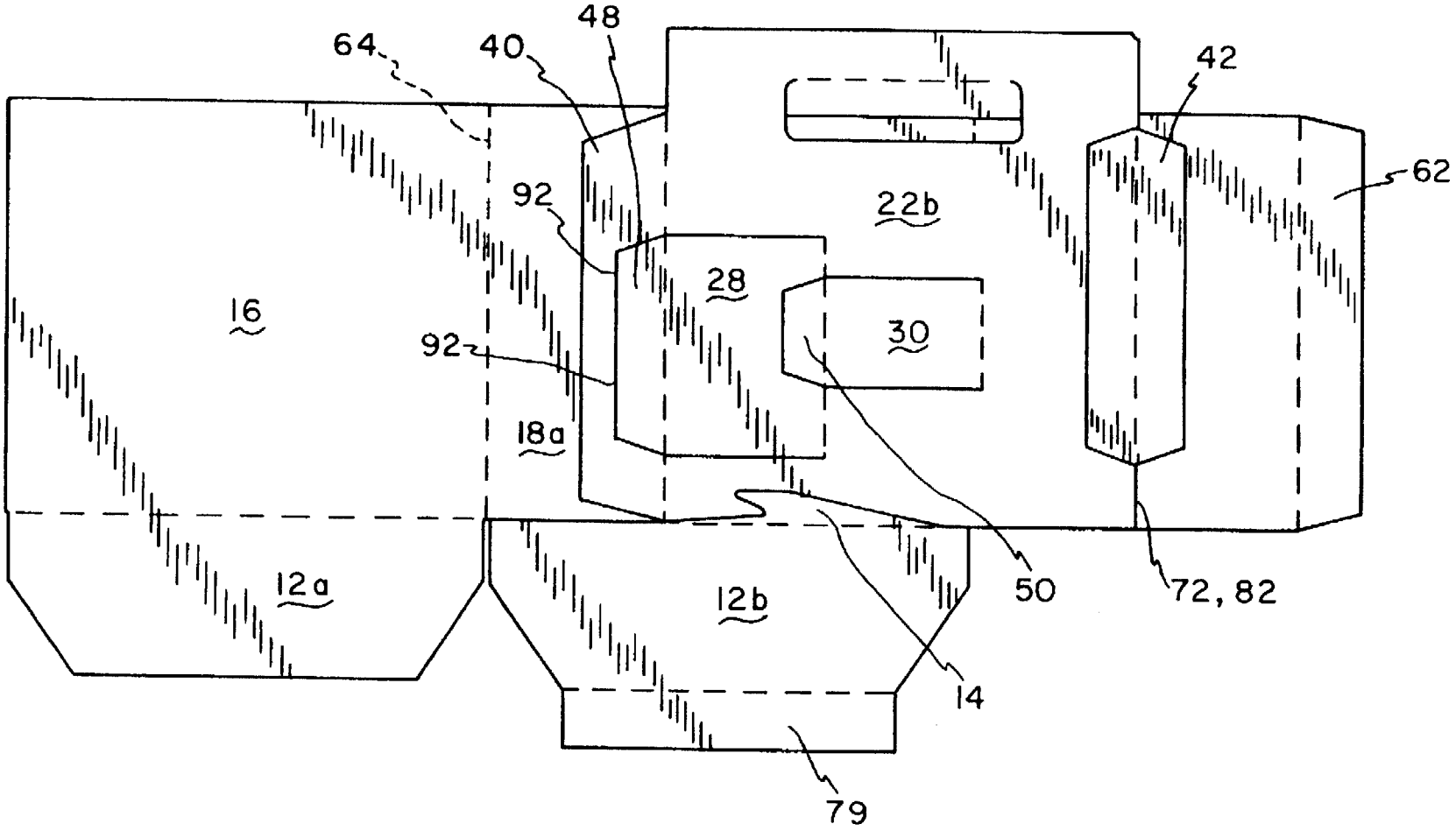

FIGS. 9 and 10 depict the sequence of folding and gluing the first and second paperboard blanks 60 and 80 to form the basket carrier 10 in non-erected (flattened) form. To achieve the blank configuration in FIG. 9 from the blank configuration in FIG. 8, the glue flap 40 is rotated (lifted) upward by at least 90 degrees relative to the longitudinal partition panel 22*b*. The glue tab 48 rotates with the glue flap 40 by virtue of their interconnection by the weakening nicks 92. With the glue flap 40 lifted upward, a "z" fold is imparted to the end wall panels 18*a–b*. More particularly, the end wall panel 18*b* is folded approximately 180 degrees relative to the side wall panel 14 about the fold line 68 such that the inner surface of the end wall panel 18*b* contacts the inner surfaces of the side wall panel 14 and the glue tab 44. The end wall panel 18*b* is simultaneously folded approximately 180 degrees relative to the end wall panel 18*a* about the fold line 66 such that the outer surface of the end wall panel 18*a* contacts the outer surface of the end wall panel 18*b*. The "z" fold is created because the folds along the fold lines 68 and 66 are imparted in opposite directions. After the end wall panels 18*a–b* have been folded in the aforementioned manner, the previously-lifted glue flap 40 is released and rotated back downward, and the inner surface thereof is adhered to the inner surface of the end wall panel 18*a*. The inner surface of the glue tab 48 remains free of adhesive so that it does not adhere to the end wall panel 18*a*. The configuration of the first and second paperboard blanks 60 and 80 after performing the folding and gluing steps described above is illustrated in FIG. 9.

FIG. 10 depicts the basket carrier 10 in non-erected (flattened) form. To achieve this non-erected form from the configuration in FIG. 9, the end wall panel 20*b* is folded approximately 180 degrees relative to the end wall panel 20*a* about the fold line 72 such that the inner surface of the end wall panel 20*b* contacts the outer surface of the longitudinal partition panel 22*b*. The side wall panel 16 is then folded approximately 180 degrees relative to the end wall panel 18*a* about the fold line 64. The outer surface of the glue flap 62 is adhered to a marginal portion of the inner surface of the folded side wall panel 16. Also, the outer surfaces of the respective glue tabs 48 and 50 are adhered to the inner surface of the side wall panel 16. Next, with the bottom wall panels 12*a–b* overlapping each other, the bottom glue flap 79 is folded approximately 180 degrees relative to the bottom wall panel 12*b*. The inner surface of the glue flap 79 is then adhered to the outer surface of the bottom wall panel 12*a*.

The aforementioned folding and gluing steps generate the basket carrier 10 in non-erected form. To erect the non-erected basket carrier 10 in FIG. 10 by hand or machine, pressure is applied to the non-erected basket carrier 10 along the lowermost edge thereof in the direction of the arrow shown in FIG. 10. Such pressure causes the overlapping bottom wall panels 12*a–b*, the overlapping end wall panels 18*a–b*, and the overlapping end wall panels 20*a–b* to "spring" or spread apart into non-overlapping relationships. Such spreading apart, in turn, causes the side walls 14 and 16 to move away from each other. Since the transverse partitions 24 and 26 are adhered to the side wall 14 by the respective glue tabs 44 and 46 and since the transverse partitions 28 and 30 are adhered to the side wall 16 by the respective glue tabs 48 and 50, the movement of the side walls 14 and 16 away from each other causes the transverse partitions 24, 26, 28, and 30 to rotate from positions aligned with (parallel to) the longitudinal partition to positions perpendicular to the longitudinal partition 22. The rotation of the transverse partition 28 away from the longitudinal partition 22, in turn, ruptures the weakening nicks 92 which had connected the glue tab 48 to the glue flap 40. The erected basket carrier 10 has the form illustrated in FIGS. 1–3. To retain the basket carrier 10 in such erected form, the locking tab 52 is engaged to the bottom wall 12.

Figure 11:
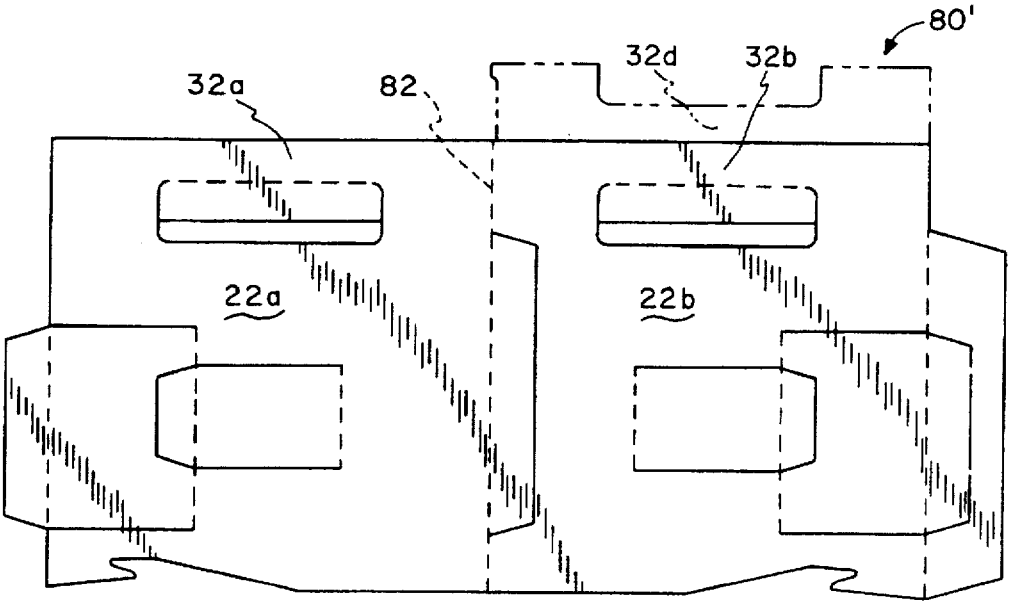
FIG. 11 is a top plan view of an inside surface of a modified second paperboard blank which can be used to form a longitudinal partition (including handle section) and transverse partitions of the basket carrier in FIGS. 1–3.

As previously stated, the handle 32 of the erected basket carrier 10 is comprised of four plies of paperboard, namely the overlapping handle portions 32*a–d* (see FIG. 5). In an alternative embodiment, the second paperboard blank 80 in FIG. 5 is modified as shown in FIG. 11 so that the handle 32 is comprised of only two or three plies. In the modified blank 80' in FIG. 11, one or both of the handle portions 32*c* and 32*d* of the second blank 80 in FIG. 5 are eliminated. When both of the handle portions 32*c* and 32*d* are eliminated, the handle 32 of the erected basket carrier 10 is comprised of two plies formed from the overlapping handle portions 32*a–b*. When only one of the handle portions 32*c* and 32*d* is eliminated, the handle 32 is comprised of three plies formed from the overlapping handle portions 32*a*, 32*b*, and 32*c* or 32*d*. The option of retaining one of the handle portions 32*c* and 32*d* is represented in FIG. 11 by phantom lines. The number of plies used to form the handle 32 depends upon the amount of strength desired in the handle area.

Figure 12:
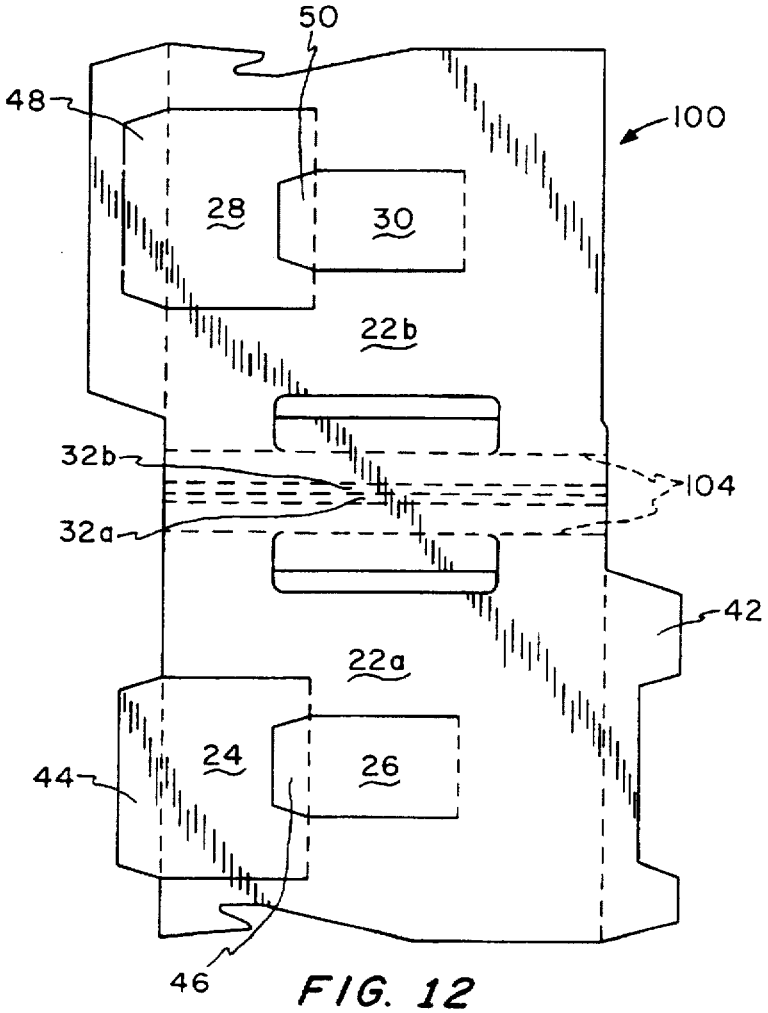
FIG. 12 is a top plan view of an inside surface of another modified second paperboard blank which can be used to form a longitudinal partition (including handle section) and transverse partitions of the basket carrier in FIGS. 1–3.

In FIG. 11, a two-ply handle 32 is generated by folding the second blank 80 about the vertical fold line 82 interconnecting the longitudinal partition panels 22*a* and 22*b*, where the handle portions 32*a* and 32*b* are formed along upper central sections of the respective longitudinal partition panels 22*a* and 22*b*. The handle portions 32*a* and 32*b* are disposed in horizontal side-by-side relationship where the elongated directions of the handle portions 32*a* and 32*b* are perpendicular to the vertical fold line 82. In an alternative embodiment depicted in FIG. 12, a two-ply handle 32 is generating from yet another modified second blank 100. With respect to the second blanks 80 and 80' described in connection with FIGS. 5 and 11, respectively, corresponding parts of the modified second blank 100 in FIG. 12 are designated by the same reference numerals. The modified second blank 100 in FIG. 12 generates a two-ply handle 32 by folding the second blank 100 about a horizontal fold line 102 interconnecting the longitudinal partition panels 22*a* and 22*b*. The handle portions 32*a* and 32*b* are disposed in vertical side-by-side relationship where the elongated directions of the handle portions 32*a* and 32*b* are parallel to the horizontal fold line 102. To further increase the strength of the handle region, a reinforcing tape or filament 104 (shown in dotted lines) may be applied to the inner surfaces of the handle portions 32*a* and 32*b*. To fold and glue the modified second paperboard blank 100 prior to joining it to the first paperboard blank 60, the longitudinal partition panel 22*b* is folded approximately 180 degrees relative to the longitudinal partition panel 22*a* about the horizontal fold line 102. The inner surface of the longitudinal partition panel 22*b* is then adhered to the inner surface of the longitudinal partition panel 22*a*. The inner surfaces of the transverse partition panels 24, 26, 28, and 30, the glue tabs 44, 46, 48, and 50, and the glue flap 42 remain free of adhesive.

Figure 13:
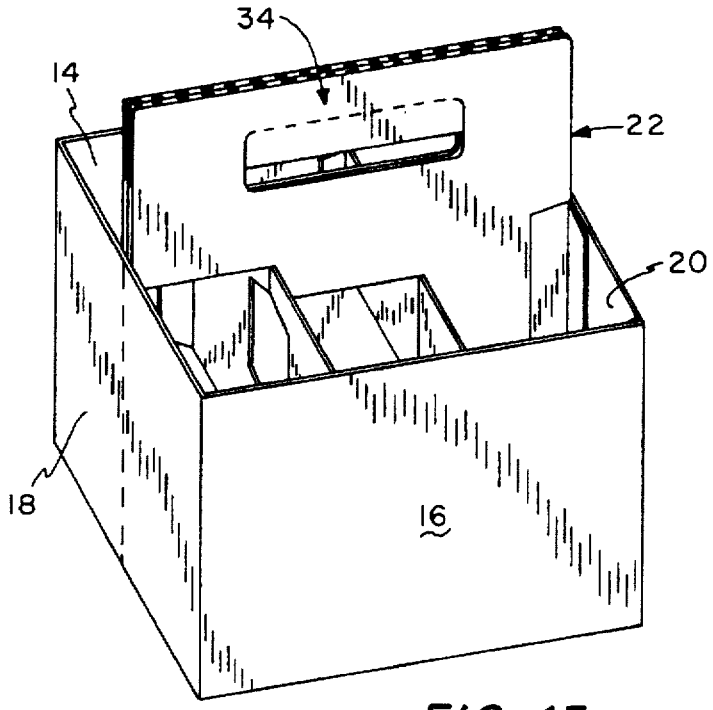
FIG. 13 is an isometric view of a modified basket carrier embodying the present invention.
Figure 14:
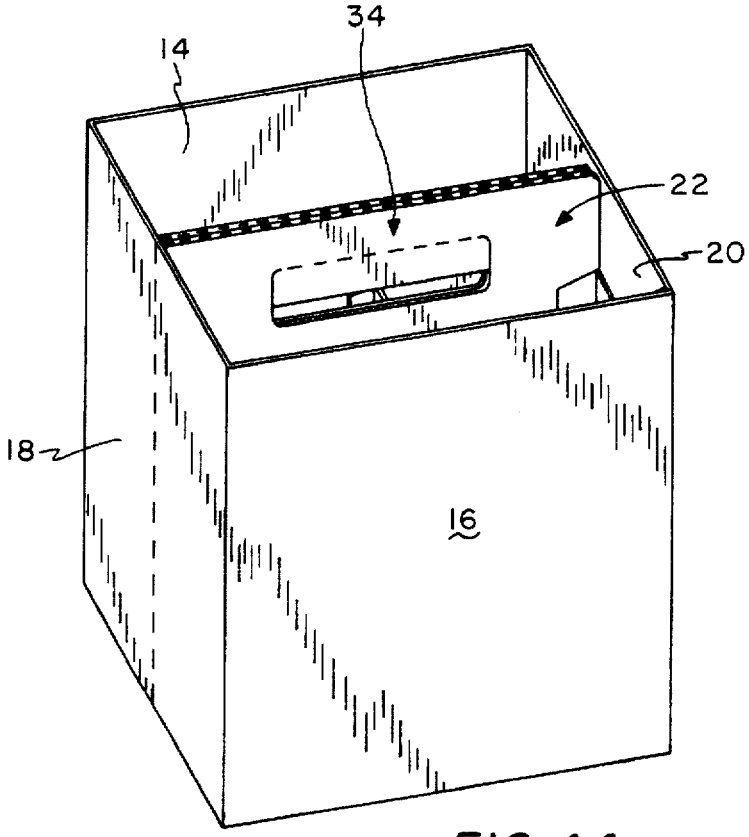
FIG. 14 is an isometric view of another modified basket carrier embodying the present invention.

Referring back to FIGS. 1 and 2, the height of the side walls 14 and 16 and the end walls 18 and 20 is such that a moderate amount of the upper central handle section 34 of the longitudinal partition 22 extends above the height of these walls. The "outboard" handle 32 substantially extends above the height of the side walls 14 and 16 and the end walls 18 and 20, while the longitudinal slot 36 is disposed below the height of these walls. The height of the side walls 14 and 16 and the end walls 18 and 20 relative to the longitudinal partition 22 may be modified, as shown in FIGS. 13 and 14, to adjust the mount of the handle section 34 which is exposed. For example, in FIG. 13 the entire handle section 34 of the longitudinal partition 22 extends above the height of the walls, while in FIG. 14 none of the handle section 34 extends above the height of the walls. If none of the handle section 34 of the longitudinal partition 22 extends above the height of the walls as in FIG. 14, the second paperboard blank forming the longitudinal partition 22 and transverse partitions 24, 26, 28, and 30 need not be printed upon and need not even be clay-coated because the foregoing elements are substantially unexposed.

Figure 15:
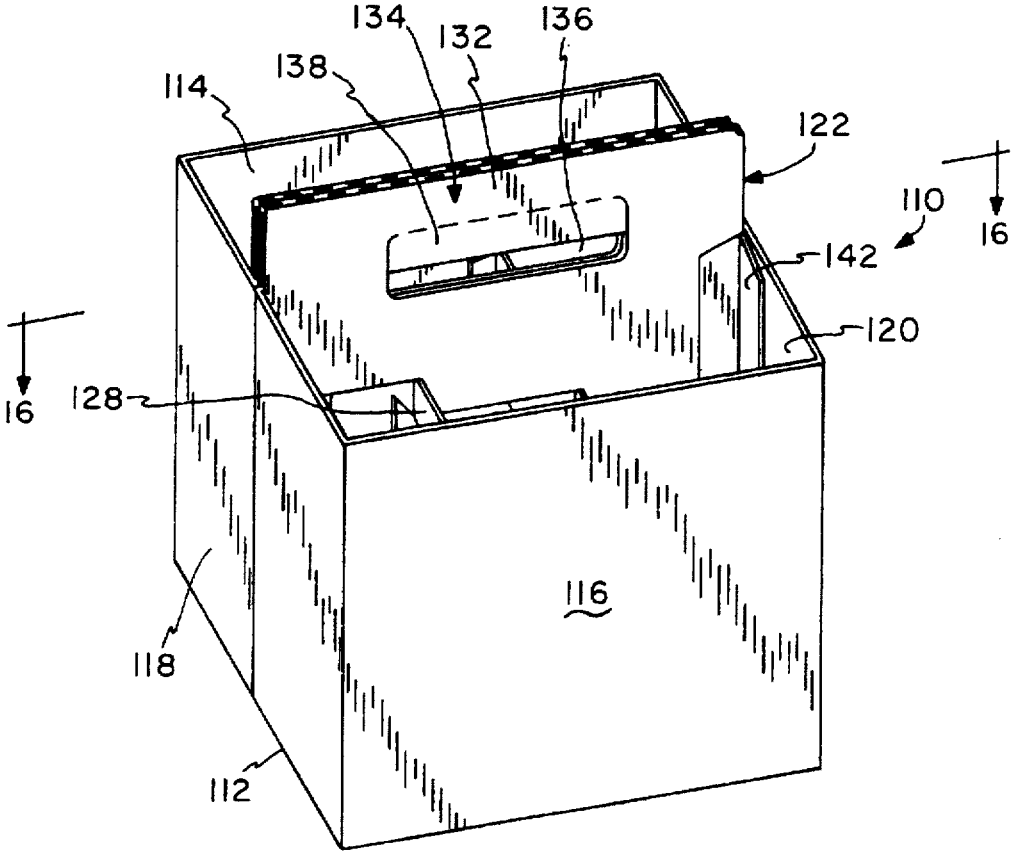
FIG. 15 is an isometric view of a further modified basket carrier embodying the present invention.
Figure 16:
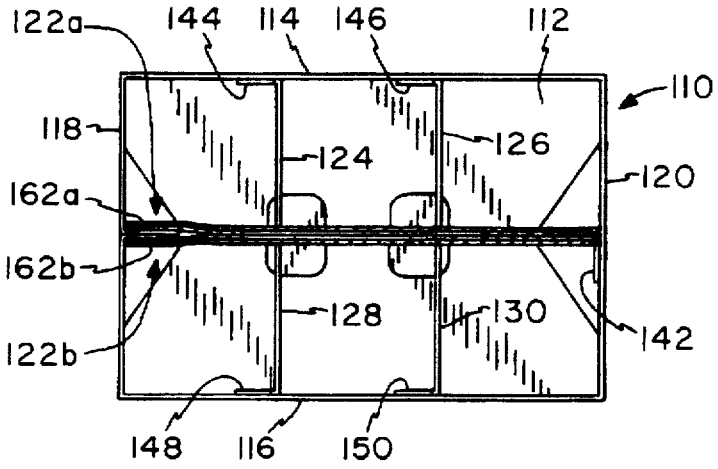
FIG. 16 is a top view of the basket carrier in FIG. 15.

FIGS. 15 and 16 depict a modified two-piece, crash-bottom basket carrier 110 embodying the present invention. Like the basket carrier 10 in FIG. 1, the basket carrier 110 includes a bottom wall 112, a pair of opposing side walls 114 and 116, a pair of opposing end walls 118 and 120, a longitudinal partition 122, and a plurality of transverse partitions 124, 126, 128, and 130. A handle 132 is formed along an upper central handle section 134 of the longitudinal partition 122 to permit carrying of the basket carrier 110. The upper central handle section 134 defines a longitudinal slot 136 to form the handle 132. The handle 132 preferably includes overlapping hinged lower flaps 138 which rotate away from the vertical direction in response to the consumer inserting their fingers through the slot 136.

Figure 17:
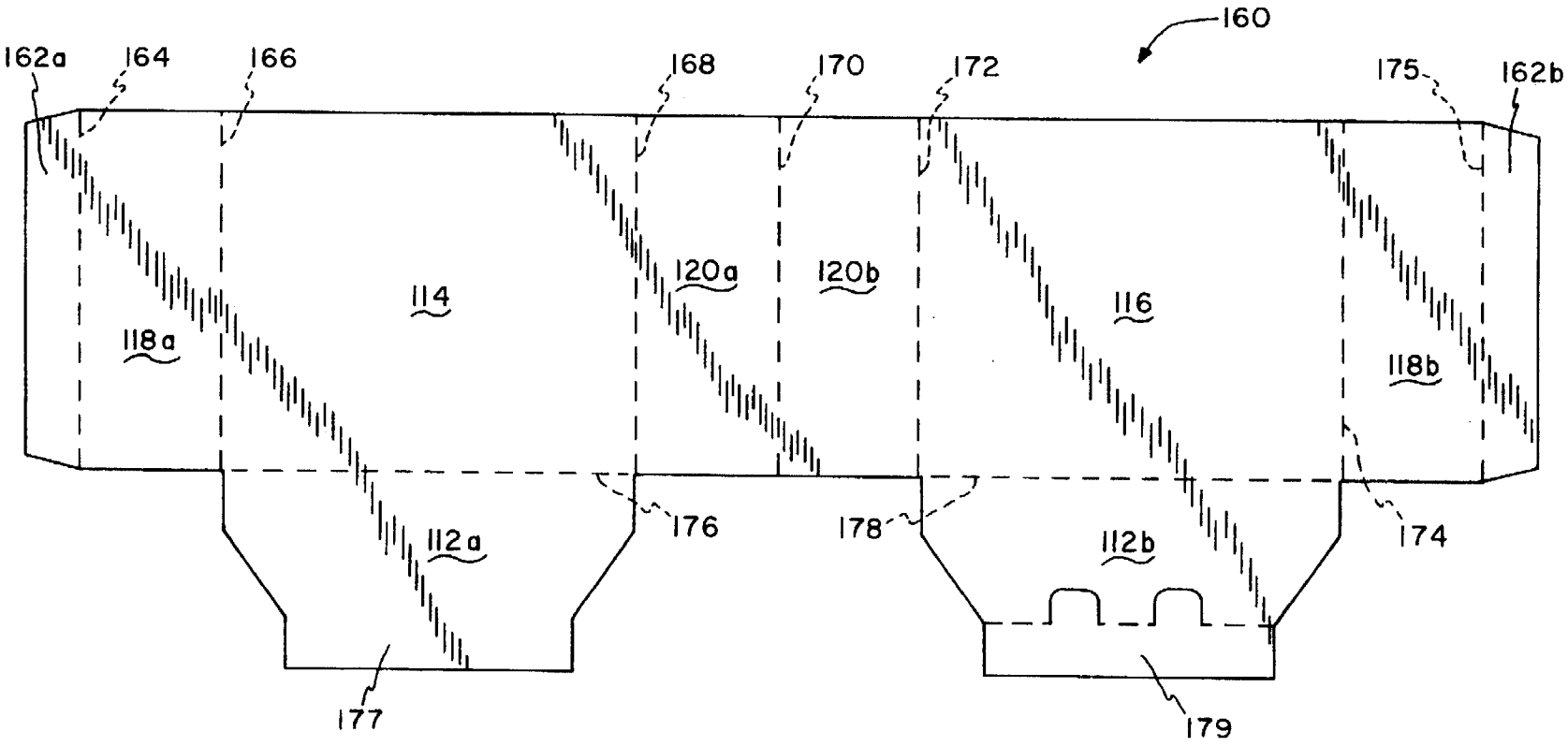
FIG. 17 is a top plan view of an inside surface of a first paperboard blank used to form a bottom wall, side walls, and end walls of the basket carrier in FIG. 15.
Figure 18:
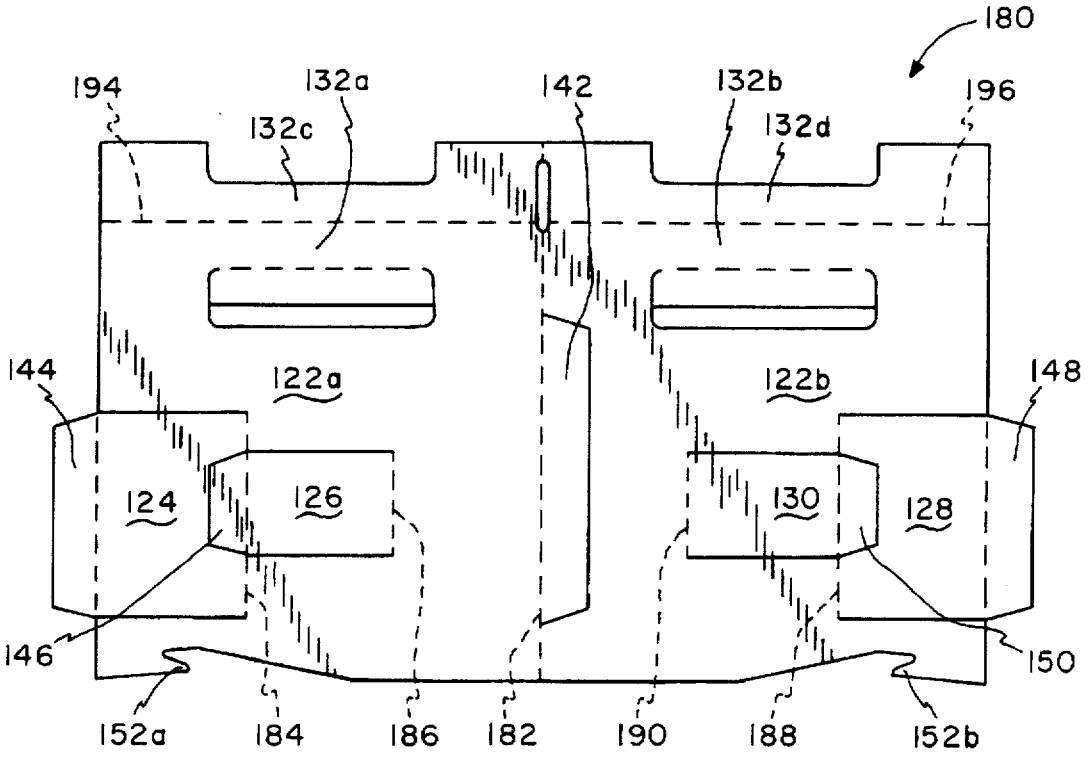
FIG. 18 is a top plan view of an inside surface of a second paperboard blank used to form a longitudinal partition (including handle section) and transverse partitions of the basket carrier in FIG. 15.

The basket carrier 110 is formed from first and second paperboard blanks depicted in FIGS. 17 and 18, respectively. The first paperboard blank 160, illustrated in FIG. 17, is used to form the bottom wall 112, side walls 114 and 116, and end walls 118 and 120 of the basket carrier 110 in FIGS. 15 and 16. The second paperboard blank 180, illustrated in FIG. 18, is used to form the longitudinal partition 122 (including handle section) and transverse partitions 124, 126, 128, and 130 of the basket carrier 110 in FIGS. 15 and 16. Each of these blanks 160 and 180 and the procedure for interconnecting, folding, and gluing these blanks to form the basket carrier 110 are described below with reference to FIGS. 17–22. With respect to the basket carrier 110 in FIGS. 15 and 16, corresponding parts of the blanks 160 and 180 are identified by the same reference numerals.

Referring first to FIG. 17, there is shown an inner surface of the first paperboard blank 160, which is preferably composed of a recycled paperboard material such as clay-coated news. The first paperboard blank 160 includes a plurality of panels and flaps hingedly connected about vertical and horizontal fold lines. More specifically, the first blank 160 includes the side wall panels 114 and 116, the end wall panels 118*a–b* and 120*a–b*, and glue flaps 162*a–b* hingedly connected about a series of vertical fold lines 164, 166, 168, 170, 172, 174, and 175. The end wall panels 118*a–b* form the end wall 118 and the end wall panels 120*a–b* form the end wall 120 of the erected basket carrier 110 in FIGS. 15 and 16. The first blank 160 further includes the bottom wall panels 112*a–b* hingedly connected to the respective side wall panels 114 and 116 about respective horizontal fold lines 176 and 178. The bottom wall panels 112*a–b* form the bottom wall 112 of the erected basket carrier 110 in FIGS. 15 and 16. Glue flaps 177 and 179 are hingedly connected to the respective bottom wall panels 112*a* and 112*b* about horizontal fold lines.

Referring to FIG. 18, there is shown an inner surface of the second paperboard blank 180, which is preferably composed of a virgin paperboard material such as clay-coated solid unbleached sulfate. The second blank 180, as previously stated, forms the longitudinal partition 122 and transverse partitions 124, 126, 128, and 130 of the basket carrier 110. The second paperboard blank 180 includes a plurality of panels and flaps hingedly connected about vertical and horizontal fold lines. More specifically, the second blank 180 includes the longitudinal partition panels 122*a–b* hingedly connected to each other about a vertical fold line 182. The longitudinal partition panels 122*a–b* form the longitudinal partition 122 of the erected basket carrier 110 in FIGS. 15 and 16. Die-cut into the second blank 180 are the plurality of transverse partition panels 124, 126, 128, and 130. The transverse partition panels 124 and 126 are partially encompassed by the longitudinal partition panel 122*a* and are hingedly connected thereto by respective vertical fold lines 184 and 186. The transverse partition panels 128 and 130 are partially encompassed by the longitudinal partition panel 122*b* and are hingedly connected thereto by respective vertical fold lines 188 and 190.

The lower edges of the respective longitudinal partition panels 122*a* and 122*b* form respective locking tab portions 152*a* and 152*b* akin to the locking tab portions 52*a* and 52*b* described in connection with FIG. 5. Handle portions 132*a–d* form the handle 132 of the erected basket carrier 110 in FIG. 15. The handle potions 132*a* and 132*b* are formed along upper central sections of the respective longitudinal partitions 122*a* and 122*b*. The optional handle portions 132*c* and 132*d* are hingedly connected to the respective handle portions 132*a* and 132*b* about respective horizontal fold lines 194 and 196. The handle portions 132*a* and 132*b* form outer plies of the handle 132 of the erected basket carrier 110, while the handle portions 132*c* and 132*d* form inner plies of the handle 132. To further increase the strength of the handle region, a reinforcing tape or filament is optionally applied to one or more of the inner surfaces of the handle portions 132*a*, 132*b*, 132*c*, and 132*d*. This reinforcing tape or filament is desirable if one or both of the optional handle portions 132*c* and 132*d* are eliminated. Hinged lower flap portions 138*a* and 138*b* and elongated slots 136*a* and 136*b* are also formed along the upper central handle sections of the respective longitudinal partitions 122*a* and 122*b*. The hinged flap portions 138*a* and 138*b* form the overlapping hinged flaps 138 and the elongated slots 136*a* and 136*b* form the longitudinal slot 136 of the erected basket carrier 110 in FIG. 15.

Figure 19:
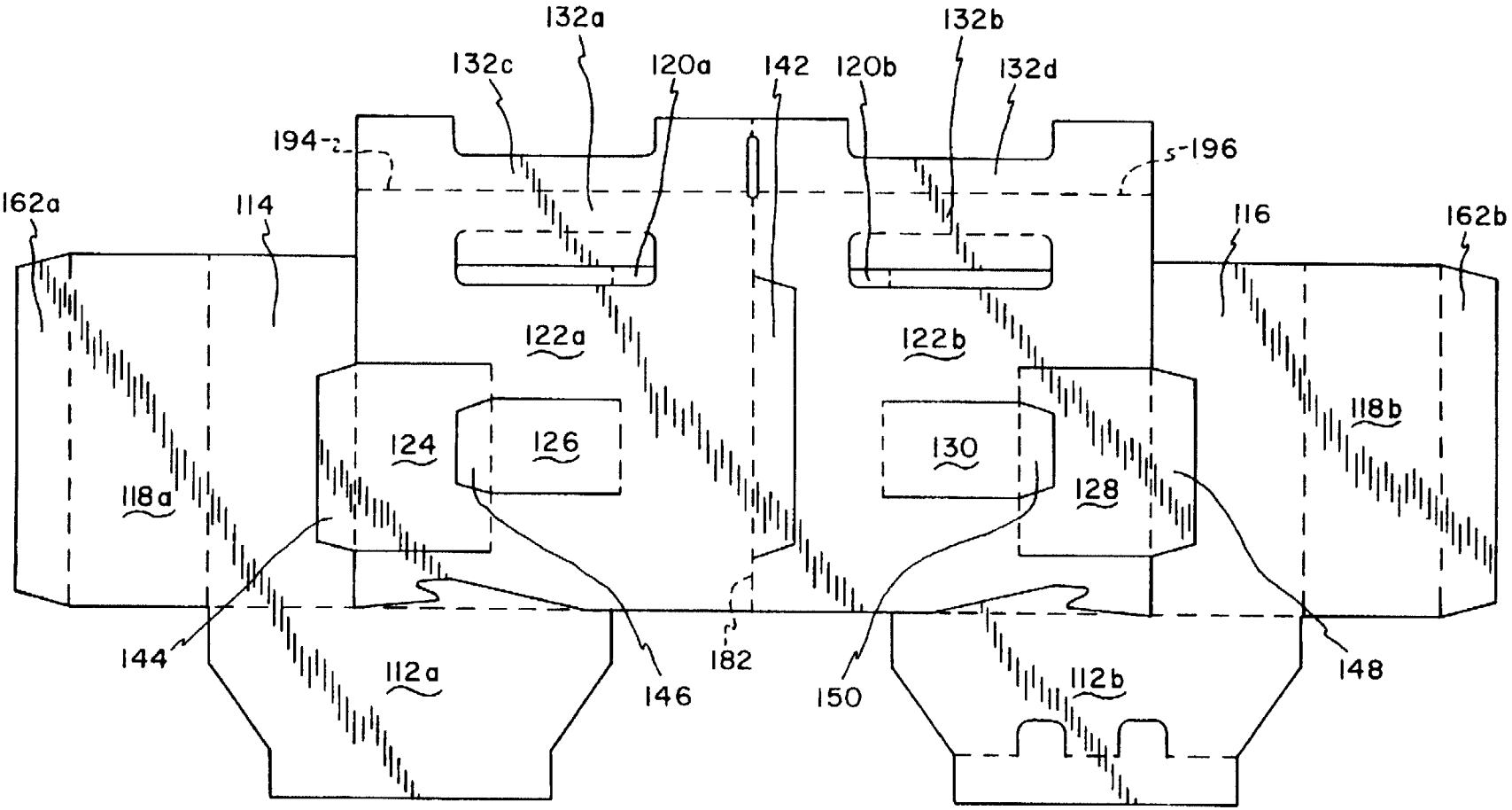
FIG. 19 is a top plan view of the first and second paperboard blanks of FIGS. 17 and 18, respectively, showing the initial positioning of these blanks relative to each other.

To form the basket carrier 110 in FIGS. 15 and 16 from the first and second blanks 160 and 180, the second paperboard blank 180 is positioned on and adhered to the first paperboard blank 160 as depicted in FIG. 19. More specifically, the fold line 182 of the second paperboard blank 180 is aligned with the fold line 170 of the first paperboard blank 160, and the lowermost edge of the second paperboard blank 180 is aligned with the lower edges of the side wall panels 114 and 116 and end wall panels 120*a–b* of the first paperboard blank 160. Using a hot melt adhesive, the outer surfaces of glue tabs 144 and 146 are adhered to the inner surfaces of the side wall panel 114, and the outer surfaces of the glue tabs 148 and 150 are adhered to the inner surfaces of the side wall panel 116. Also, using a cold adhesive, the outer surface of the glue flap 142 is adhered to the inner surface of the end wall panel 120*b*.

Figure 22:
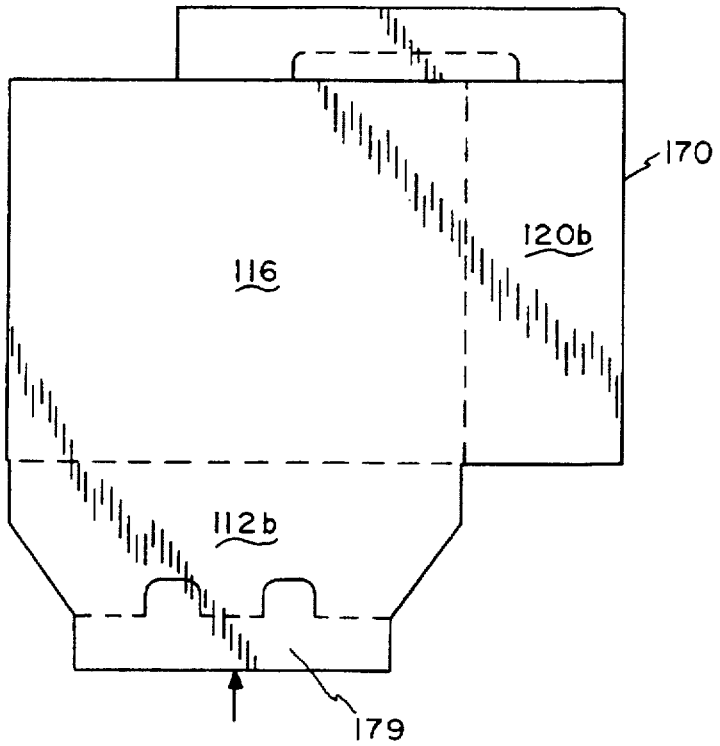
FIGS. 20, 21, and 22 are top plan views showing the sequence of folding and gluing the first and second paperboard blanks to form the basket carrier in non-erected (flattened) form as shown in FIG. 22.
Figure 20:
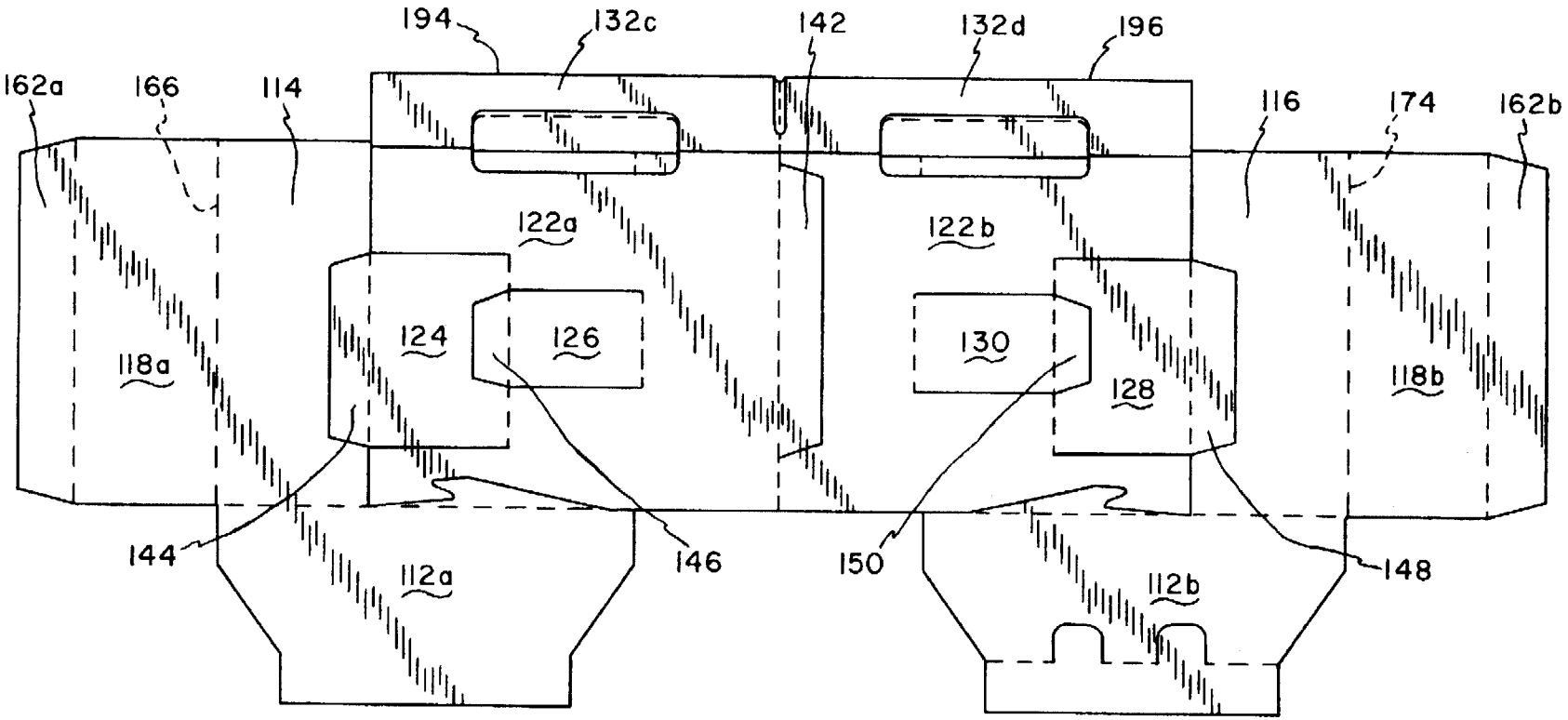
Figure 21:
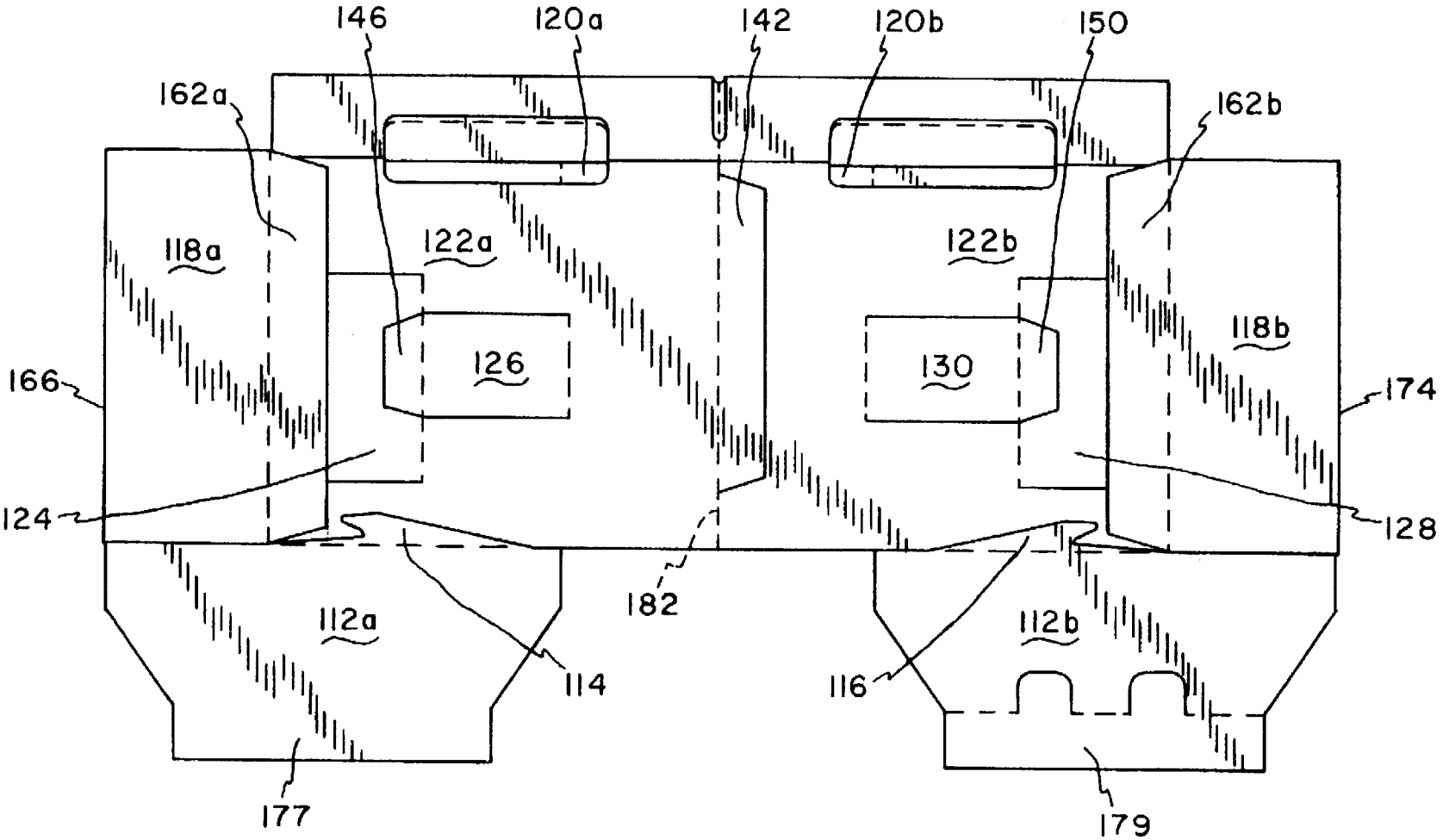

FIGS. 20, 21, and 22 depict the sequence of folding and gluing the first and second paperboard blanks 160 and 180 to form the basket carrier 110 in non-erected (flattened) form. To achieve the blank configuration in FIG. 20 from the blank configuration in FIG. 19, the handle portions 132*c* and 132*d* are folded downward approximately 180 degrees relative to the respective handle portions 132*a* and 132*b* about the respective horizontal fold lines 194 and 196. Using a hot melt adhesive, the inner surfaces of the handle portions 132*c* and 132*d* are adhered to the inner surfaces of the respective handle portions 132*a* and 132*b*.

Next, to achieve the blank configuration in FIG. 21 from the blank configuration in FIG. 20, the end wall panel 118*a* is folded inward approximately 180 degrees relative to the side wall panel 114 about the fold line 166, and the inner surface of the glue flap 162*a* is adhered to the inner surface of the left marginal portion of the longitudinal partition panel 122*a* using a hot melt adhesive. Adjacent or abutting portions of the transverse partition panel 124 and the glue flap 162*a* remain free of adhesive so that the transverse partition panel 124 is free to move relative to the glue flap 162*a*. Similarly, the end wall panel 118*b* is folded inward approximately 180 degrees relative to the side wall panel 116 about the fold line 174, and the inner surface of the glue flap 162*b* is adhered to the inner surface of the right marginal portion of the longitudinal partition panel 122*b* using a cold adhesive. Adjacent or abutting portions of the transverse partition panel 128 and the glue flap 162*b* remain free of adhesive so that the transverse partition panel 128 is free to move relative to the glue flap 162*b*.

To achieve the non-erected basket carrier in FIG. 22 from the blank configuration in FIG. 21, the end wall panel 120*b* is folded inward approximately 180 degrees relative to the end wall panel 120*a* about the fold line 170 (see FIG. 17), and the outer surface of the glue flap 162*b* is adhered to the outer surface of the glue flap 162*a*. Rotation of the end wall panel 120*b* causes the longitudinal partition panel 122*b* to move in tandem therewith such that the longitudinal partition panel 122*b* is folded relative to the longitudinal partition panel 122*a* about the fold line 182. The inner surface of the longitudinal partition panel 122*b* is adhered to the inner surface of the longitudinal partition panel 122*a*. As the blank configuration in FIG. 21 is substantially symmetrical about the aligned fold lines 170 and 182, the glue flaps 162*a* and 162*b* register with each other when the structure in FIG. 21 is folded. Likewise, the glue flaps 177 and 179 register with each other when the structure in FIG. 21 is folded. The inner surfaces of the glue flaps 177 and 179 are adhered to each other.

FIG. 22 depicts the basket carrier 110 in non-erected (flattened) form. To erect the non-erected basket carrier 110 in FIG. 22 by hand or machine, pressure is applied to the non-erected basket carrier 110 along the lowermost edge thereof in the direction of the arrow shown in FIG. 22. Such pressure causes the overlapping bottom wall panels 112*a–b*, the overlapping end wall panels 118*a–b*, and the overlapping end wall panels 120*a–b* to "spring" or spread apart into non-overlapping relationships. Such spreading apart, in turn, causes the side walls 114 and 116 to move away from each other. Since the transverse partitions 124 and 126 are adhered to the side wall 114 by the respective glue tabs 144 and 146 and since the transverse partitions 128 and 130 are adhered to the side wall 116 by the respective glue tabs 148 and 150, the movement of the side walls 114 and 116 away from each other causes the transverse partitions 124, 126, 128, and 130 to rotate from positions aligned with (parallel to) the longitudinal partition to positions perpendicular to the longitudinal partition 122. The erected basket carrier 110 has the form illustrated in FIGS. 15 and 16. To retain the basket carrier 110 in such erected form, the locking tab formed from the locking tab portions 152*a* and 152*b* is engaged to the bottom wall 112 in a manner similar to that shown in FIG. 2 for the locking tab 52.

One difference between the basket carrier 10 in FIGS. 1–3 and the basket carrier 110 in FIGS. 15 and 16 relates to the manner in which the longitudinal partition is connected to the end wall panels. In the basket carrier 10 of FIGS. 1–3, the longitudinal partition 22 is connected to the end wall panels 18 and 20 by the respective glue flaps 40 and 42 extending from opposing ends of the partition 22. In the basket carrier 110 of FIGS. 15 and 16, the longitudinal partition 122 is connected to the end wall panel 120 at one end by the glue flap 142 extending from the partition 122 and is connected to the end wall panel 118 at the other end by the glue flaps 162*a* and 162*b* extending from the respective end wall panels 118*a* and 118*b*. As best shown in FIG. 16, the glue flaps 162*a* and 162*b* are trapped and secured between the panels 122*a* and 122*b* forming the longitudinal partition 122. The glue flaps 162*a* and 162*b* are adhered to each other and to the respective longitudinal partition panels 122*a* and 122*b*.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A two-piece, crash bottom basket carrier, comprising:

a bottom wall, a pair of opposing side walls, and a pair of opposing end walls all being formed from a first unitary paperboard blank and defining an interior of the basket carrier, said side walls and said end walls extending upward from said bottom wall, said end walls bridging said opposing side walls; and a longitudinal partition and transverse partition all being formed from a second unitary paperboard blank and dividing said interior into a plurality of cells, said longitudinal partition forming a handle along an upper central handle section thereof, said longitudinal partition extending between said opposing end walls and extending upward from said bottom wall, each of said transverse partitions extending between said longitudinal partition and an associated one of said side walls;

the basket carrier being convertible from a flattened form to an erected form in response to applying pressure to said bottom wall, said bottom wall including a pair of flaps, said flaps being connected to each other prior to converting said basket carrier from said flattened form to said erected form.

2. The basket carrier of claim 1, wherein said longitudinal partition is located approximately midway between said opposing side walls, said longitudinal partition being generally perpendicular to the bottom wall and said end walls and being generally parallel to said side walls, and wherein said transverse partitions are generally perpendicular to said bottom wall and said side walls and are generally parallel to said end walls.

3. The basket carrier of claim 1, wherein said longitudinal partition includes first and second generally overlapping longitudinal partition panels hingedly connected along a horizontal fold line, said horizontal fold line being generally parallel to said bottom wall, said first and second longitudinal partition panels including respective first and second handle portions immediately adjacent to and hingedly connected along said horizontal fold line, said first and second handle portions forming respective first and second plies of said handle, and wherein said transverse partitions include a first transverse partition hingedly connected to said first longitudinal partition panel and a second transverse partition hingedly connected to said second longitudinal partition panel.

4. The basket carrier of claim 1, further including a reinforcing tape applied to said handle.

5. The basket carrier of claim 1, wherein said longitudinal partition is connected to said end walls and said transverse partitions are connected to respective ones of said side walls.

6. The basket carrier of claim 5, further including glue flaps extending from opposing ends of said longitudinal partition and connecting said longitudinal partition to said end walls.

7. The basket carrier of claim 5, further including a first glue flap extending from one end of said longitudinal partition and connecting said longitudinal partition to one of said end walls, and second glue flaps extending from the other of said end walls and connecting said longitudinal partition to the other of said end walls.

8. The basket carrier of claim 1, wherein said first paperboard blank is generally symmetrical about a first fold line of symmetry.

9. The basket carrier of claim 8, wherein said second paperboard blank is generally symmetrical about a second fold line of symmetry.

10. A two-piece, crash bottom basket carrier, comprising:

a bottom wall, a pair opposing side walls, and a pair of opposing end walls all being formed from a first unitary paperboard blank and defining an interior of the basket carrier, said side walls and said end walls extending upward from said bottom wall, said end walls bridging said opposing side walls; and a longitudinal partition and transverse partitions all being formed from a second unitary paperboard blank and dividing said interior into a plurality of cells, said longitudinal partition forming a handle along an upper central handle section thereof, said longitudinal partition extending between said opposing end walls and extending upward from said bottom wall, said longitudinal partition including first and second generally overlapping longitudinal partition panels hingedly connected along a vertical fold line, said vertical fold line being generally perpendicular to said bottom wall, said first and second longitudinal partition panels including respective first and second handle portions forming respective first and second plies of said handle, each of said transverse partitions extending between said longitudinal partition and an associated one of said side walls;

the basket carrier being convertible from a flattened form to an erected form in response to applying pressure to said bottom wall.

11. The basket carrier of claim 10, wherein said first and second longitudinal partition panels are generally symmetrical about said vertical fold line.

12. The basket carrier of claim 11, wherein said handle portions are elongated in a direction generally perpendicular to said vertical fold line.

13. The basket carrier of claim 10, further including a third handle portion hingedly connected to said first longitudinal partition panel along an upper horizontal edge thereof, said third handle portion being folded along said upper horizontal edge of said first longitudinal partition panel to generally overlap said first handle portion, said third handle portion forming a third ply of said handle.

14. The basket carrier of claim 13, further including a fourth handle portion hingedly connected to said second longitudinal partition panel along an upper horizontal edge thereof, said fourth handle portion being folded along said upper horizontal edge of said second longitudinal partition panel to generally overlap said second handle portion, said fourth handle portion forming a fourth ply of said handle.

15. A two-piece, crash bottom basket carrier, comprising:

a bottom wall, a pair of opposing side walls, and a pair of opposing end walls all being formed from a first unitary paperboard blank and defining an interior of the basket carrier, said side walls and said end walls extending upward from said bottom wall, said end walls bridging said opposing side walls; and a longitudinal partition and transverse partitions all being formed from a second unitary paperboard blank and dividing said interior into a plurality of cells, said longitudinal partition forming a handle along an upper central handle section thereof, said longitudinal partition extending between said opposing end walls and extending upward from said bottom wall, said longitudinal partition being connected to said end walls, said transverse partitions being connected to respective ones of said side walls, a first glue flap extending from one end of said longitudinal partition and connecting said longitudinal partition to one of said end walls, at least one second group flap extending from the other of said end walls and connecting said longitudinal partition to the other of said end walls, said longitudinal partition including first and second generally overlapping longitudinal partition panels, said at least one second group flaps being secured between said first and second longitudinal panels, each of said transverse partitions extending between said longitudinal partition and an associated one of said side walls;

the basket carrier being convertible from a flattened form to an erected form in response to applying pressure to said bottom wall.

16. A blank structure for forming a basket carrier, comprising:

a first paperboard blank configured to form a bottom wall, side walls, and end walls of the basket carrier; and a second paperboard blank, connected to said first blank, for forming longitudinal and transverse partitions of the basket carrier, said second blank including first and second longitudinal partition panels hingedly connected to each other along a vertical fold line, said first and second longitudinal partition panels forming respective first and second handle portions elongated in a direction generally perpendicular to said vertical fold line, said first and second handle portions being symmetrically disposed about said vertical fold line, said second blank including first and second transverse partition panels hingedly connected to and partially encompassed by said respective first and second longitudinal partition panels.

17. The blank structure of claim 16, wherein said second blank is generally symmetrical about said vertical fold line.

18. The blank structure of claim 16, further including a reinforcing tape applied along at least one of said handle portions.

19. The blank structure of claim 16, further including a third handle portion hingedly connected to said first handle portion along a first horizontal fold line, said first horizontal fold line being generally perpendicular to said vertical fold line.

20. The blank structure of claim 19, further including a fourth handle portion hingedly connected to said second handle portion along a second horizontal fold line, said second horizontal fold line being generally perpendicular to said vertical fold line.

21. The blank structure of claim 16, wherein said first blank is generally symmetrical about a line of symmetry.

* * * * *